US009207553B2

(12) United States Patent
Sugimoto et al.

(10) Patent No.: US 9,207,553 B2
(45) Date of Patent: Dec. 8, 2015

(54) TONER, DEVELOPER AND IMAGE FORMING APPARATUS

(71) Applicants: Tsuyoshi Sugimoto, Shizuoka (JP); Hiroshi Yamashita, Shizuoka (JP); Susumu Chiba, Shizuoka (JP); Satoyuki Sekiguchi, Shizuoka (JP)

(72) Inventors: Tsuyoshi Sugimoto, Shizuoka (JP); Hiroshi Yamashita, Shizuoka (JP); Susumu Chiba, Shizuoka (JP); Satoyuki Sekiguchi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/915,804

(22) Filed: Jun. 12, 2013

(65) Prior Publication Data

US 2013/0337374 A1 Dec. 19, 2013

(30) Foreign Application Priority Data

Jun. 18, 2012 (JP) ..... 2012-136935

(51) Int. Cl.
*G03G 9/087* (2006.01)
*G03G 9/08* (2006.01)

(52) U.S. Cl.
CPC ..... *G03G 9/0821* (2013.01); *G03G 9/08755* (2013.01); *G03G 9/08795* (2013.01); *G03G 9/08797* (2013.01)

(58) Field of Classification Search
CPC .. G03G 9/08; G03G 9/08797; G03G 9/08788
USPC ..... 430/105
See application file for complete search history.

(56) References Cited

U.S. PATENT DOCUMENTS

| | | | | |
|---|---|---|---|---|
| 2008/0227002 | A1 | 9/2008 | Moriya et al. | |
| 2009/0068578 | A1* | 3/2009 | Murakami et al. | 430/105 |
| 2009/0214973 | A1 | 8/2009 | Sugimoto et al. | |
| 2010/0035170 | A1 | 2/2010 | Sugimoto et al. | |
| 2010/0310980 | A1 | 12/2010 | Sugimoto et al. | |
| 2011/0076607 | A1 | 3/2011 | Sugimoto et al. | |
| 2011/0223532 | A1 | 9/2011 | Sugimoto et al. | |
| 2011/0262856 | A1 | 10/2011 | Sugimoto et al. | |
| 2012/0052434 | A1 | 3/2012 | Sugimoto et al. | |
| 2012/0189951 | A1* | 7/2012 | Sugimoto et al. | 430/108.2 |
| 2012/0219896 | A1* | 8/2012 | Asahina et al. | 430/109.4 |
| 2013/0059247 | A1 | 3/2013 | Sugimoto et al. | |

FOREIGN PATENT DOCUMENTS

| | | |
|---|---|---|
| JP | 2579150 | 11/1996 |
| JP | 11-133665 | 5/1999 |
| JP | 2001-158819 | 6/2001 |
| JP | 2002-287400 | 10/2002 |

(Continued)

OTHER PUBLICATIONS

Diamond, "Handbook of Imaging Materials," Marcel Dekker, NY, NY 1991. pp. 380-382.*

(Continued)

*Primary Examiner* — Peter Vajda
(74) *Attorney, Agent, or Firm* — Oblon, McClelland, Maier & Neustadt, L.L.P.

(57) ABSTRACT

To provide a toner including a binder resin and a colorant, wherein the toner has a glass transition temperature by differential scanning calorimetry (DSC) of 20° C. or greater and less than 50° C., an endothermic peak temperature by DSC of 50° C. or greater and less than 80° C. and an amount of compressive deformation at 50° C. by a thermomechanical analysis of 5% or less.

18 Claims, 4 Drawing Sheets

(56) References Cited

FOREIGN PATENT DOCUMENTS

| | | |
|---|---|---|
| JP | 2002-351143 | 12/2002 |
| JP | 2008-262179 | 10/2008 |
| JP | 2009-300848 | 12/2009 |
| JP | 2011-059603 | 3/2011 |

OTHER PUBLICATIONS

U.S. Appl. No. 13/751,620 filed Jan. 28, 2013.

* cited by examiner

TONER, DEVELOPER AND IMAGE FORMING APPARATUS

BACKGROUND OF THE INVENTION

1. Field of the Invention

The present invention relates to a toner, a developer and an image forming apparatus.

2. Description of the Related Art

In recent years, a toner is required to have a small particle diameter and high temperature-resistant offset property for a high-quality output image, low-temperature fixing property for energy saving, and heat-resistant storage stability for sustainability in a high-temperature and high-humidity environment during storage and transport of the toner. In particular, power consumption during fixing accounts for the majority of the power consumption in an image forming method, and improvement of low-temperature fixing property is very important.

Conventionally, a toner prepared by a kneading and pulverizing method has been used, where a toner composition obtained by melt-mixing and uniformly dispersing a colorant, a releasing agent and so on in a binder resin is pulverized and classified. It is difficult to reduce a particle diameter of the toner prepared by the kneading and pulverizing method, and at the same time, there have been problems such as insufficient quality of an output image thereof and high fixing energy due to its irregular shape and its broad particle diameter distribution. Also, when a releasing agent (wax) is added in order to improve fixability, the toner prepared by the kneading and pulverizing method is cracked at an interface of the wax during pulverization, and as a result, the wax exists predominantly on a surface of the toner. Thus, while a releasing effect is obtained, adhesion of the toner to a carrier, a photoconductor and a cleaning blade (filming) is likely to occur, and overall performance has not been satisfactory.

In order to solve the problems of the toner by the kneading and pulverizing method, various toner manufacturing methods by a polymerization method are proposed. A toner prepared by the polymerization method has a small particle diameter and a sharp particle size distribution, and it is possible to encapsulate a releasing agent.

As the toner manufacturing method by the polymerization method, for example, a method for manufacturing a toner from an elongation product of urethane-modified polyester has been proposed for the purpose of improving low-temperature fixing property and high temperature-resistant offset property (see Japanese Patent Application Laid-Open (JP-A) No. 11-133665).

Also, a toner having superior powder fluidity and transfer property as a toner having a small particle diameter and at the same time having superior heat-resistant storage stability, low-temperature fixing property and high temperature-resistant offset property has been proposed (see JP-A No. 2002-287400 and JP-A No. 2002-351143).

Also, a toner manufacturing method including an aging step has been proposed for producing a toner binder having a stable molecular weight distribution and obtaining both low-temperature fixing property and high temperature-resistant offset property (see Japanese Patent (JP-B) No. 2579150 and JP-A No. 2001-158819).

However, these proposed technologies cannot satisfy low-temperature fixing property of a higher level required in recent years.

Thus, for the purpose of obtaining low-temperature fixing property of a higher level, for example, there has been proposed a toner composed of a resin (a) which does not include a polyhydroxycarboxylic acid skeleton composed of an optically active monomer and a resin (b) having a polyhydroxycarboxylic acid skeleton composed of an optically active monomer, wherein the resin (a) is a polyester resin having crystallinity (see JP-A No. 2011-59603).

Also, a toner including a block copolymer composed of a crystalline polyester block and a non-crystalline polyester block as a core and a non-crystalline polyester resin as an outer shell has been proposed (see JP-A No. 2009-300848).

According to these proposals, low-temperature fixing of the toners may be achieved since the crystalline polyester resin quickly melts compared to the non-crystalline polyester resin. However, even though the crystalline polyester resin corresponding to an island in a sea-island phase-separation structure melts, the non-crystalline polyester resin corresponding to the sea as a majority does not melt. Since fixing cannot occur until both the crystalline polyester resin and the non-crystalline polyester resin melt to some degree, these proposed techniques cannot satisfy low-temperature fixing property of a higher level.

Accordingly, it has been desired to propose a toner which causes no filming and has superior low-temperature fixing property, high temperature-resistant offset property and heat-resistant storage stability.

SUMMARY OF THE INVENTION

The present invention aims at providing a toner which causes no occurrences of filming and has superior low-temperature fixing property, high temperature-resistant offset property and heat-resistant storage stability.

A toner of the present invention as a means for solving the above problems includes a binder resin and a colorant, wherein the toner has a glass transition temperature by differential scanning calorimetry (DSC) of 20° C. or greater and less than 50° C., an endothermic peak temperature by differential scanning calorimetry (DSC) of 50° C. or greater and less than 80° C. and an amount of compressive deformation at 50° C. by a thermomechanical analysis of 5% or less.

The present invention can solve the conventional problems and provide a toner which causes no occurrences of filming and has superior low-temperature fixing property, high temperature-resistant offset property and heat-resistant storage stability.

DETAILED DESCRIPTION OF THE INVENTION (Toner)

Figure 1:
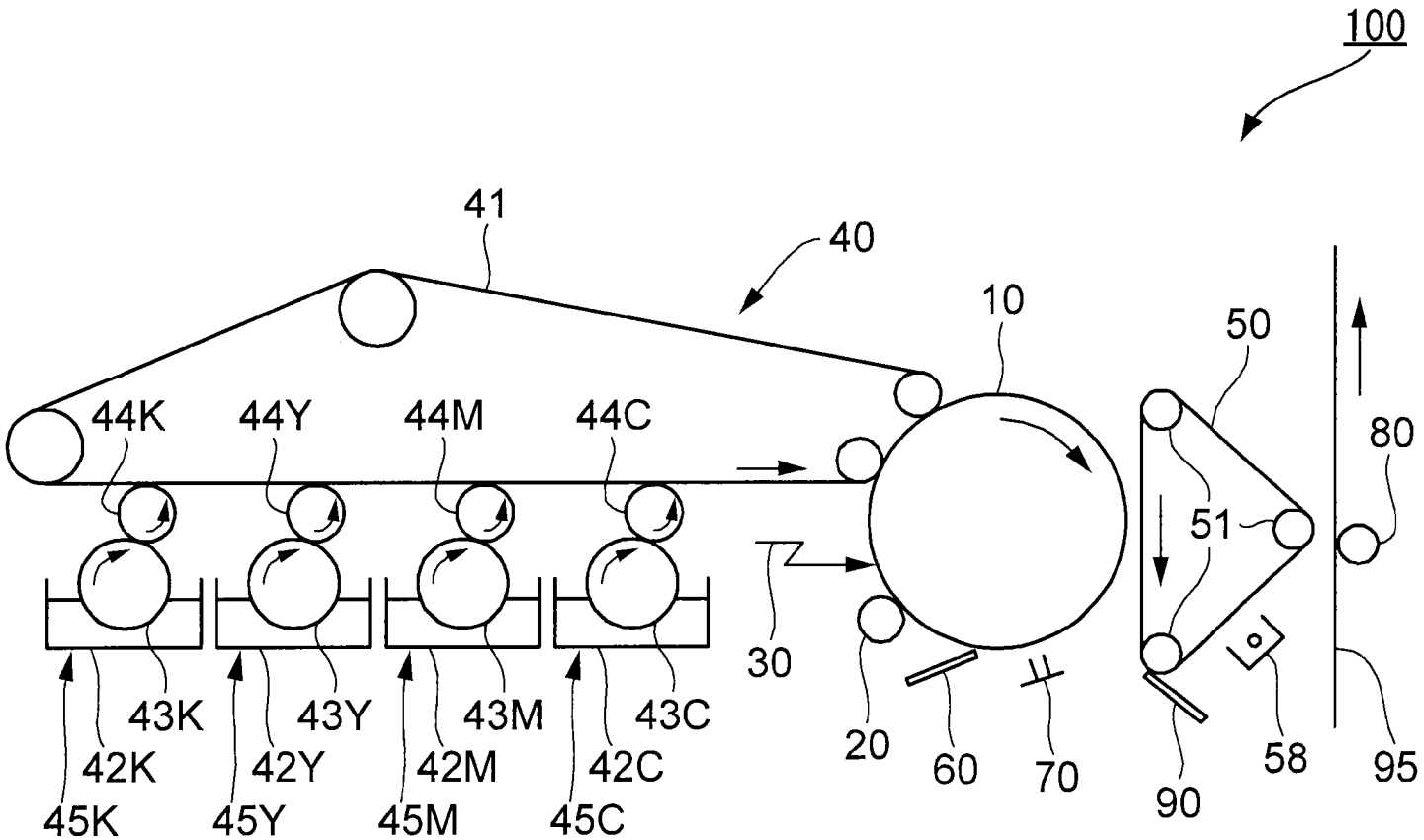
FIG. 1 is a schematic diagram illustrating one example of an image forming apparatus of the present invention.

A toner of the present invention includes a binder resin and a colorant, and it further includes other components according to necessity.

<Binder Resin>

The binder resin preferably includes a resin having a crystalline portion.

The resin having a crystalline portion is not particularly restricted, and it may be appropriately selected according to purpose. Examples thereof include a crystalline resin and a copolymer at least partially including a crystalline portion.

The binder resin is not particularly restricted as long as it has a crystalline portion, and it may be appropriately selected according to purpose. Nonetheless, it preferably includes: a crystalline resin A; a non-crystalline resin B; and a resin E having a crystalline portion C and a non-crystalline portion D in a molecule thereof.

The toner of the present invention has a low glass transition temperature Tg by differential scanning calorimetry (DSC method) compared to a conventional toner. However, due to crystallinity of the crystalline resin A included in the toner, deformation of the toner at a temperature above the glass transition temperature Tg is suppressed. Thus, an amount of compressive deformation (TMA amount of compressive deformation) at 50° C. by thermomechanical analysis is reduced. Accordingly, the toner can maintain heat-resistant storage stability.

Also, the crystalline resin A melts at an endothermic peak temperature mp, which is a peak of melting of the crystalline resin A included in the toner, and along with the melting of the crystalline resin A, the non-crystalline resin B having a low glass transition temperature Tg also softens to a melt viscosity with which it is capable of adhering to a recording medium. Thus, compared to a conventional toner, it is possible to exhibit low-temperature fixing property at a very high level.

Further, the resin E having the crystalline portion C and the non-crystalline portion D in a molecule thereof, which is included in the toner, has a molecular skeleton similar to each of the crystalline resin A and the non-crystalline resin B and has an affinity (compatibility) with both the crystalline resin A and the non-crystalline resin B. Thus, it acts as a tie between the crystalline resin A and the non-crystalline resin B. As a result, thermal deformation becomes difficult due to the crystalline structure of the crystalline resin A despite a low glass transition temperature Tg of the non-crystalline resin B, and it is possible to maintain heat-resistant storage stability of the toner. Also, although a melt viscosity largely decreases and high temperature-resistant offset property may degrade only with the crystalline resin A, the melt viscosity may be maintained with the non-crystalline resin B to a degree that a high-temperature offset is not caused.

The glass transition temperature Tg of the toner by the DSC method is 20° C. or greater and less than 50° C., and it is preferably 20° C. to 40° C., and more preferably 30° C. to 40° C. in view of low-temperature fixing property.

When the glass transition temperature is less than 20° C., there are cases where heat-resistant storage stability degrades even though the crystalline portion is present in the toner. When it is 50° C. or greater, melting of the non-crystalline portion is insufficient with respect to melting of the crystalline portion in the toner, and there are cases low-temperature fixing property is inferior. The glass transition temperature within the preferable range is advantageous since both low-temperature fixing property and heat-resistant storage stability of the toner may be obtained.

An endothermic peak temperature mp of the toner by the DSC method is 50° C. or greater and less than 80° C., and it is preferably 55° C. to 70° C. When the endothermic peak temperature is less than 50° C., the crystalline resin A melts in an expected high-temperature storage environment of the toner, and there are cases where the toner has degraded heat-resistant storage stability. When it is 80° C. or greater, the non-crystalline resin B softens, but it is likely that the crystalline resin A melts only at a high temperature. Thus, there are cases where low-temperature fixing property of the toner degrades.

The toner is not particularly restricted, and it may be appropriately selected according to purpose. Nonetheless, a ratio Q2/Q1 of an endothermic quantity Q2 of a second DSC heating to an endothermic quantity Q1 of a first DSC heating due to melting of the crystalline portion (e.g., the crystalline resin A and the crystalline portion C of the resin E) is preferably 0 or greater and less than 0.3. The endothermic quantity Q1 is not particularly restricted, and it may be appropriately selected according to purpose. Nonetheless, it is preferably greater than 10 J/g, and more preferably 20 J/g or greater, and an upper limit thereof is preferably 100 J/g or less.

When the ratio Q2/Q1 is 0.3 or greater, compatibility between the crystalline portion and the non-crystalline portion in the toner during heating in fixing is insufficient, and there are cases that low-temperature fixing property and high temperature-resistant offset property of the toner may be inferior.

When the endothermic quantity Q1 is 10 μg or less, an amount of the crystalline portion present in the toner is reduced. Deformation of the toner in an expected high-temperature storage environment of the toner cannot be suppressed, and heat-resistant storage stability of the toner may degrade.

Here, the glass transition temperature Tg of the toner, the endothermic peak temperature mp of the toner and the endothermic quantities (Q1, Q2) of the toner by the DSC method may be measured as follows.

A measurement object is stored in an isothermal environment having a temperature of 45° C. and a humidity of 20% RH or less for 24 hours in order to have constant initial conditions of the crystalline portion and the non-crystalline portion. It is then stored at a temperature of 23° C. or less, and Tg, mp, Q1 and Q2 are measured within 24 hours. By this operation, an effect of thermal history in a high-temperature storage environment may be reduced, and the condition of the crystalline portion and the non-crystalline portion of the toner may be uniformized.

First, 5 mg of a particulate toner is sealed in a T-ZERO simple sealing pan, manufactured by TA Instruments, and a measurement is made using a differential scanning calorimeter (DSC) (manufactured by TA Instruments, Q2000). Regarding the measurement, under a stream of nitrogen, the toner is heated as a first heating from −20° C. to 200° C. at a heating rate of 10° C./min, maintained for 5 minutes, then cooled to −20° C. at a cooling rate of 10° C./min, maintained for 5 minutes, and then heated as a second heating to 200° C. at a heating rate of 10° C./min. Thermal changes are measured, and graphs of "endothermic-exothermic quantity" and "temperature" are created. A temperature at a characteristic inflection point observed at this time is defined as the glass transition temperature Tg.

As the glass transition temperature Tg, a value obtained by a mid-point method in the analysis programs of the apparatus using the graph of the first heating may be used.

Also, the endothermic peak temperature mp may be calculated as a maximum peak temperature using an analysis program of the apparatus using the graph of the first heating.

Also, the Q1 may be calculated as an amount of heat of fusion of the crystalline component using an analysis program of the apparatus using the graph of the first heating.

Also, the Q2 may be calculated as an amount of heat of fusion of the crystalline component using an analysis program of the apparatus using the second heating.

An amount of compressive deformation of the toner at 50° C. by thermomechanical analysis (TMA amount of compressive deformation) is 5% or less, and preferably 1% to 4%. When the TMA amount of compressive deformation exceeds 5%, the toner deforms and fuses in an expected high-temperature storage environment of the toner, and there are cases where the toner has degraded heat-resistant storage stability. The TMA amount of compressive deformation within the preferable range is advantageous since both low-temperature fixing property and heat-resistant storage stability of the toner may be obtained.

In the present invention, by incorporating into the toner the resin E having the crystalline portion C and the non-crystalline portion D in a molecule thereof, the resin E acts as a tie between the crystalline resin A and the non-crystalline resin B, and the TMA amount of compressive deformation may be adjusted at a low value compared to a case where the resin E is not included. Thus, by analyzing that the toner has the TMA amount of compressive deformation of 5% or less, it is possible to prove that the toner includes the resin E.

Here, the TMA amount of compressive deformation may be measured, for example, by using 0.5 g of the toner formed into a tablet by a tablet molding machine (manufactured by Shimadzu Corporation) having a diameter of 3 mm with a thermo-mechanical measuring apparatus (EXSTAR7000, manufactured by SII NanoTechnology Inc.). The tablet is heated at 2° C./min from 0° C. to 180° C. under a stream of nitrogen, and the measurement is carried out in a compressed mode. A compressive force at this time is 100 mN. The amount of compressive deformation at 50° C. is read from an obtained graph of a sample temperature and a compression displacement (deformation ratio), and this value is referred to as the TMA amount of compressive deformation.

The toner is not particularly restricted, and it may be appropriately selected according to purpose. Nonetheless, a relative crystallinity obtained from an area of the crystalline portion and an area of the non-crystalline portion by the x-ray diffraction method is preferably 10% to 50%, and more preferably 20% to 40%. When the relative crystallinity is less than 10%, the toner has a decreased amount of the crystalline portion present therein. As a result, deformation of the toner in an expected high-temperature storage environment of the toner cannot be suppressed, and there are cases where the toner has degraded heat-resistant storage stability. When it exceeds 50%, the melt viscosity largely decreased during fixing, and there are cases where high temperature-resistant offset property and low-temperature fixing property of the toner degrade.

Here, the relative crystallinity of the toner may be measured using, for example, a crystallinity analysis x-ray diffractometer (X'PERT MRD, manufactured by Philips) as follows.

First, the toner as a target sample is ground by a mortar to prepare a sample powder, and the obtained sample powder is uniformly applied to a sample holder. Thereafter, the sample holder is set in the crystallinity analysis x-ray diffractometer, and a measurement is made to obtain a diffraction spectrum.

Among obtained diffraction peaks, a peak in a range of $20° < 2\theta < 25°$ is regarded as an endothermic peak derived from the crystalline portion. Also, a broad peak spreading widely across the measurement area is regarded as a component derived from the non-crystalline portion. For each peak, an integrated area of the diffraction spectrum from which a background is subtracted is calculated. An area value derived from the crystalline portion is regarded as Sc, and an area value derived from the non-crystalline portion is regarded as Sa. From Sc/Sa, the relative crystallinity may be calculated.

Measurement conditions of the x-ray diffraction method are as follows.

[Measurement Conditions]

Tension kV: 45 kV
Current: 40 mA
MPSS
Upper
Gonio
Scanmode: continuous
Start angle: 3°
End angle: 35°
Angle Step: 0.02°
Lucident beam optics
Divergence slit: Div slit 1/2
Diflection beam optics
Anti scatter slit: As Fixed 1/2
Receiving slit: Prog rec slit <<Crystalline resin A>>

The crystalline resin A is not particularly restricted, and it may be appropriately selected according to purpose. Nonetheless, polyester resins are preferable since they melt sharply during fixing and have sufficient flexibility and durability even with a reduced molecular weight. Among the polyester resins, aliphatic polyester resins are particularly preferable since they have superior sharp melt property and high crystallinity.

The aliphatic polyester resins may be obtained by condensation polymerization of a polyhydric alcohol and a polycarboxylic acid or a derivative thereof such as polycarboxylic acid, polycarboxylic acid anhydride and polycarboxylic acid ester.

—Polyhydric Alcohol—

The polyhydric alcohol is not particularly restricted, and it may be appropriately selected according to purpose. Examples thereof include diols and trihydric or higher alcohols.

Examples of the diols include saturated aliphatic diols. Examples of the saturated aliphatic diols include linear saturated aliphatic diols and branched saturated aliphatic diols. Among these, the linear saturated aliphatic diols are preferable, and the linear saturated aliphatic diols having 2 to 12 carbon atoms are more preferable. When the saturated aliphatic diols are branched, the crystallinity of the crystalline polyester resin decreases, which may result in a decreased melting point. When the number of carbon atoms of the saturated aliphatic diols exceeds 12, such a material may not be easily available Thus, the number of carbon atoms is preferably 12 or less.

Examples of the saturated aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol and 1,14-eicosanedecanediol. These may be used alone or in combination of two or more.

Among these, ethylene glycol, 1,4-butanediol, 1,6-hexanediol, 1,8-octanediol, 1,10-decanediol and 1,12-dodecanediol are particularly preferable since the crystalline polyester resin has high crystallinity and superior sharp melt property.

Examples of the trihydric or higher alcohols include glycerin, trimethylolethane, trimethylolpropane and pentaerythritol. These may be used alone or in combination of two or more.

—Polycarboxylic Acid—

The polycarboxylic acid is not particularly restricted, and it may be appropriately selected according to purpose.

Examples thereof include divalent carboxylic acid and trivalent or higher carboxylic acid.

Examples of the divalent carboxylic acid include: saturated aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid and 1,18-octadecanedicarboxylic acid; aromatic dicarboxylic acids such as phthalic acid, isophthalic acid, terephthalic acid, naphthalene-2,6-dicarboxylic acid, malonic acid and mesaconic acid; and anhydrides thereof and lower (1 to 3 carbon atoms) alkyl esters thereof. These may be used alone or in combination of two or more.

Examples of the trivalent or higher carboxylic acid include 1,2,4-benzene tricarboxylic acid, 1,2,5-benzene tricarboxylic acid, 1,2,4-naphthalene tricarboxylic acid, anhydrides thereof and lower (1 to 3 carbon atoms) alkyl esters thereof. These may be used alone or in combination of two or more.

Here, as the polycarboxylic acid, in addition to the saturated aliphatic dicarboxylic acid and the aromatic dicarboxylic acid, a dicarboxylic acid having a sulfonic acid group, a dicarboxylic acid having a double bond and so on may be included.

The crystalline polyester resin is obtained preferably by condensation polymerization of a linear saturated aliphatic dicarboxylic acid having 4 to 12 carbon atoms and a linear saturated aliphatic diol having 2 to 12 carbon atoms. That is, the crystalline polyester resin preferably includes a structural unit derived from a saturated aliphatic dicarboxylic acid having 4 to 12 carbon atoms and a structural unit derived from a saturated aliphatic diol having 2 to 12 carbon atoms. As a result, the obtained crystalline polyester resin has high crystallinity and superior sharp melt property, and the toner can exhibit superior low-temperature fixing property.

The crystallinity, the molecular structure and so on of the crystalline polyester resin may be confirmed by an NMR measurement, differential scanning calorimetry (DSC) measurement, x-ray diffraction measurement, a GC/MS measurement, an LC/MS measurement, an infrared absorption (IR) spectrum measurement and so on.

A melting point of the crystalline resin A is not particularly restricted, and it may be appropriately selected according to purpose. Nonetheless, it is preferably 50° C. to 80° C. When the melting point is less than 50° C., it is likely that the crystalline resin A melts at a low temperature, which may result in degraded heat-resistant storage stability of the toner. When it exceeds 80° C., heating during fixing insufficiently melts the crystalline resin A, which may result in degraded low-temperature fixing property of the toner.

A weight-average molecular weight of the crystalline resin A is not particularly restricted, and it may be appropriately selected according to purpose. Nonetheless, it is preferably 3,000 to 50,000, and more preferably 5,000 to 25,000.

The weight-average molecular weight of the crystalline resin A may be measured, for example, by gel permeation chromatography (GPC).

A glass transition temperature of the crystalline resin A is not particularly restricted, and it may be appropriately selected according to purpose. Nonetheless, it is preferably 50° C. to 70° C.

The glass transition temperature of the crystalline resin A may be measured, for example, by differential scanning calorimetry (DSC method).

A content of the crystalline resin A in the toner is not particularly restricted, and it may be appropriately selected according to purpose. Nonetheless, it is preferably 3% by mass to 30% by mass, and more preferably 5% by mass to 20% by mass. When the content is less than 3% by mass, there are cases where the toner has degraded heat-resistant storage stability and low-temperature fixing property. When it exceeds 30% by mass, there are cases where filming occurs, resulting in degraded high temperature-resistant offset property.

<<Non-Crystalline Resin B>>

The non-crystalline resin B is not particularly restricted, and it may be appropriately selected according to purpose. Examples thereof include a resin having a repeating unit derived from a compound obtained by dehydration condensation of lactic acid such as resin having a polyhydroxycarboxylic acid skeleton and non-crystalline polyester resin since it has superior affinity with paper as a major recording medium and the toner has superior heat-resistant storage stability. Among these, a resin having a polyhydroxycarboxylic acid skeleton with racemized lactic acid composed of L-lactic acid and D-lactic acid as a raw material is particularly preferable since the toner has superior low-temperature fixing property.

The resin having a polyhydroxycarboxylic acid skeleton has an optical purity X (%) in terms of monomer component represented by the following formula of preferably 90% or less.

$$X(\%)=|X(\text{L-form})-X(\text{D-form})|$$

Here, in the formula, the X (L-form) represents a ratio (%) of an L-form in terms of lactic acid monomer, and the X (D-form) represents a ratio (%) of an D-form in terms of lactic acid monomer.

Here, a method for measuring the optical purity X is not particularly restricted, and it may be appropriately selected according to purpose. For example, a polymer or a toner having a polyester skeleton is added to a mixed solvent of pure water, 1-N sodium hydroxide and isopropyl alcohol, which is heated and stirred at 70° C. for hydrolysis. Next, it is filtered to remove a solid content in the liquid and then neutralized by adding a sulfuric acid, and an aqueous solution including at least any one of L-lactic acid and D-lactic acid decomposed from the polyester resin is obtained. The aqueous solution is measured by a high-performance liquid chromatograph (HPLC) using a column of the chiral ligand exchange type, SUMICHIRAL OA-5000 (manufactured by Sumika Chemical Analysis Service, Ltd.), and a peak area derived from L-lactic acid S(L) and a peak area derived from D-lactic acid S(D) are calculated. From the peak areas, the optical purity X may be obtained as follows.

$$X(\text{L-form})\ \%=100\times S(L)/(S(L)+S(D))$$

$$X(\text{D-form})\ \%=100\times S(D)/(S(L)+S(D))$$

$$\text{Optical purity } X\ \%=|X(\text{L-form})-X(\text{D-form})|$$

Here, the L-form and the D-form used as the raw materials are optical isomers, and the optical isomer have identical physical properties and chemical properties other than optical properties. Thus, their reactivities are equal when they are polymerized, and component ratios of the monomers are identical to component ratios of the monomers in the polymer.

The optical purity of 90% or less is preferable since solvent solubility and transparency of the resin improve.

The X (D-form) and the X (L-form) of the monomers which form the resin having a polyhydroxycarboxylic acid skeleton have the same ratio as the D-form and the L-form of the monomers used for forming the resin having a polyhydroxycarboxylic acid skeleton. Thus, the optical purity X(%)

in terms of monomer components of the resin having a polyhydroxycarboxylic acid skeleton as the non-crystalline resin B may be controlled by using appropriate amounts of monomers of the L-form and the D-form in combination.

A method for manufacturing the resin having a polyhydroxycarboxylic acid skeleton is not particularly restricted, and heretofore known conventional methods may be used. For example, the method for manufacturing the resin having a polyhydroxycarboxylic acid skeleton may be a method of fermenting starch such as corn as a raw material to obtain lactic acid, followed by direct dehydration condensation of the lactic acid or followed by formation of the lactic acid into cyclic dimeric lactide and synthesis by ring-opening polymerization in a presence of catalyst. Among these, the manufacturing method by the ring-opening polymerization is preferable since it can control the molecular weight with an amount of an initiator and complete the reaction in a short period of time.

The non-crystalline polyester resin is not particularly restricted, and it may be appropriately selected according to purpose. Nonetheless, a non-modified polyester resin is preferable. The non-modified polyester resin is a polyester resin obtained by condensation polymerization of a polyhydric alcohol a polycarboxylic acid or a derivative thereof such as polycarboxylic acid, polycarboxylic acid anhydride and polycarboxylic acid ester, and it is a polyester resin not modified by an isocyanate compound and so on.

The polyhydric alcohol is not particularly restricted, and it may be appropriately selected according to purpose. Examples thereof include a diol.

Examples of the diol include alkylene (2 to 3 carbon atoms) oxide (average number of moles added of 1 to 10) adduct of bisphenol A such as polyoxypropylene(2,2)-2,2-bis(4-hydroxyphenyl)propane and polyoxyethylene(2,2)-2,2-bis(4-hydroxyphenyl)propane; ethylene glycol, propylene glycol; alkylene (2 to 3 carbon atoms) oxide (average number of moles added of 1 to 10) adduct such as hydrogenated bisphenol A and hydrogenated bisphenol A. These may be used alone or in combination of two or more.

The polycarboxylic acid is not particularly restricted, and it may be appropriately selected according to purpose. Examples thereof include dicarboxylic acid.

Examples of the dicarboxylic acid include: adipic acid, phthalic acid, isophthalic acid, terephthalic acid, fumaric acid, maleic acid; and succinic acid substituted by an alkyl group having 1 to 20 carbon atoms or an alkenyl group having 2 to 20 carbon atoms such as dodecenylsuccinic acid and octylsuccinic acid. These may be used alone or in combination of two or more.

The non-crystalline polyester resin may include at least any one of a trivalent or higher carboxylic acid and a trihydric or higher alcohol at an end of the resin chain for the purpose of adjusting an acid value and a hydroxyl value.

Examples of the trivalent or higher carboxylic acid include trimellitic acid, pyromellitic acid and acid anhydrides thereof.

Examples of the trihydric or higher alcohol include glycerin, pentaerythritol and trimethylolpropane.

A weight-average molecular weight of the non-crystalline resin B is not particularly restricted, and it may be appropriately selected according to purpose. Nonetheless, it is preferably 3,000 to 30,000, more preferably 5,000 to 20,000.

The weight-average molecular weight of the non-crystalline resin B may be measured, for example, by gel permeation chromatography (GPC).

A glass transition temperature of the non-crystalline resin B is not particularly restricted, and it may be appropriately selected according to purpose. Nonetheless, it is preferably 40° C. to 70° C. When the glass transition temperature is less than 40° C., heat-resistant storage stability degrades, which may cause filming. When it exceeds 70° C., there are cases where low-temperature fixing property degrades.

The glass transition temperature of the non-crystalline resin B may be measured by differential scanning calorimetry (DSC method).

A content of the non-crystalline resin B in the toner is not particularly restricted, and it may be appropriately selected according to purpose. Nonetheless, it is preferably 30% by mass to 90% by mass, and more preferably 50% by mass to 85% by mass.

<<Resin E>>

The resin E is not particularly restricted as long as it has the crystalline portion C and the non-crystalline portion D in a molecule thereof, and it may be appropriately selected according to purpose. Examples thereof include; a copolymer of a repeating unit derived from a crystalline monomer and a repeating unit derived from a non-crystalline monomer; a copolymer of a repeating unit derived from a crystalline oligomer and a repeating unit derived from a non-crystalline oligomer; a copolymer of a repeating unit derived from a crystalline polymer and a repeating unit derived from a non-crystalline polymer; and combinations thereof. Among these, the copolymer of the repeating unit derived from a crystalline polymer and the repeating unit derived from a non-crystalline polymer is particularly preferable in view of compatibility of the resin E with the crystalline resin A and the non-crystalline resin B.

An embodiment of copolymerization in the copolymer is not particularly restricted, and it may be appropriately selected according to purpose. Nonetheless, a block copolymerization is preferable.

Examples of the crystalline polymer in the repeating unit derived from a crystalline polymer include the crystalline resin A.

Examples of the non-crystalline polymer in the repeating unit derived from a non-crystalline polymer include the non-crystalline resin B.

A method for the copolymerization is not particularly restricted, and it may be appropriately selected according to purpose. Examples thereof include any one of the following methods (1) to (3).

(1) A non-crystalline resin prepared in advance by polymerization reaction and a crystalline resin prepared in advance by polymerization reaction are dissolved or dispersed in an appropriate solvent and then reacted with an elongation agent having two or more functional groups which reacts with a hydroxyl group or a carboxylic acid at an end of a polymer chain such as isocyanate group and epoxy group for copolymerization.

(2) A non-crystalline resin prepared in advance by polymerization reaction and a crystalline resin prepared in advance by polymerization reaction are melt-kneaded, and a copolymer is prepared by transesterification reaction thereof under a reduced pressure.

(3) Using a hydroxyl group of a crystalline resin prepared in advance by polymerization reaction as a polymerization initiator component, a ring-opening polymerization of a non-crystalline resin is carried out from an end of a polymer chain of the crystalline resin for copolymerization.

—Crystalline Portion C—

The crystalline portion C preferably includes a common skeleton composed of a monomer unit of the same type as the crystalline resin A since it improves affinity (compatibility)

between the crystalline resin A and the resin E and provides superior heat-resistant storage stability and low-temperature fixing property of the toner.

As the skeleton of the crystalline portion C composed of the monomer unit, that similar to the crystalline resin A may be used, but aliphatic polyester is particularly preferable. The aliphatic polyester may be appropriately selected from those similar to the crystalline resin A.

A mass ratio (A/C) of a mass (g) of the crystalline resin A to a mass (g) of the crystalline portion C of the resin E is not particularly restricted, and it may be appropriately selected according to purpose. Nonetheless, it is preferably 0.5 to 3.0, more preferably 0.6 to 2.0, and further more preferably 0.8 to 1.2. The mass ratio (A/C) within the more preferable range is advantageous since both low-temperature fixing property and heat-resistant storage stability of the toner may be obtained.

—Non-crystalline Portion D—

The non-crystalline portion D preferably includes a common skeleton composed of a monomer unit of the same type as the non-crystalline resin B since it improves affinity (compatibility) between the non-crystalline resin B and the resin E and provides superior heat-resistant storage stability and low-temperature fixing property of the toner.

As the skeleton of the non-crystalline portion D composed of the monomer unit, that similar to the non-crystalline resin B may be used, but the polyhydroxycarboxylic acid skeleton is particularly preferable. The resin having a polyhydroxycarboxylic acid skeleton may be appropriately selected from those similar to the non-crystalline resin B.

A mass ratio (B/D) of a mass (g) of the non-crystalline resin B to a mass (g) of the non-crystalline portion D of the resin E is not particularly restricted, and it may be appropriately selected according to purpose. Nonetheless, it is preferably 0.5 to 10.0, more preferably 1.0 to 5.0, and further more preferably 1.5 to 2.5. The mass ratio (B/D) within the more preferable range is advantageous since both low-temperature fixing property and heat-resistant storage stability of the toner may be obtained.

A weight-average molecular weight of the resin E is not particularly restricted, and it may be appropriately selected according to purpose. Nonetheless, it is preferably 3,000 to 50,000, more preferably 5,000 to 30,000.

The weight-average molecular weight of the resin E may be measured, for example, by gel permeation chromatography (GPC).

A glass transition temperature of the resin E is not particularly restricted, and it may be appropriately selected according to purpose. Nonetheless, it is preferably 30° C. to 70° C., and more preferably 40° C. to 60° C.

The glass transition temperature of the resin E may be measured, for example, by differential scanning calorimetry (DSC method).

A mass ratio (C/D) of a mass (g) of the crystalline portion C and a mass (g) of the non-crystalline portion D in the resin E is not particularly restricted, and it may be appropriately selected according to purpose. Nonetheless, it is preferably 0.25 to 2.5, and more preferably 0.3 to 1.5. When the mass ratio is outside the preferable numerical range, the tying effect of the resin E with the crystalline resin A and the non-crystalline resin B decreases, and there are cases where low-temperature fixing property and heat-resistant storage stability of the toner degrades.

A content of the resin E in the toner is not particularly restricted, and it may be appropriately selected according to purpose. Nonetheless, it is preferably 1% by mass to 30% by mass, and more preferably 5% by mass to 15% by mass. When the content is less than 1% by mass, the tying effect of the resin E with the crystalline resin A and the non-crystalline resin B decreases, and there are cases where low-temperature fixing property and heat-resistant storage stability of the toner degrades. The content exceeding 30% by mass impairs sharp melt property of the toner, which may result in degraded low-temperature fixing property of the toner.

<Colorant>

The colorant is not particularly restricted, and it may be appropriately selected according to purpose. Examples thereof include carbon black, nigrosine dye, iron black, naphthol yellow S, Hansa Yellow (10G, 5G, G), cadmium yellow, yellow iron oxide, yellow ocher, chrome yellow, titanium yellow, polyazo yellow, Oil Yellow, Hansa Yellow (GR, A, RN, R), Pigment Yellow L, Benzidine Yellow (G, GR), Permanent Yellow (NCG), Vulcan Fast Yellow (5G, R), tartrazine lake, Quinoline Yellow Lake, Anthrazane Yellow BGL, Isoindolinone Yellow, colcothar, red lead, lead vermilion, cadmium red, Cadmium Mercury Red, antimony vermilion, Permanent Red 4R, Para Red, fiser red, para-chloro-orthonitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red FSR, Brilliant Carmine 6B, Pigment Scarlet 3B, bordeaux 5B, Toluidine Maroon, Permanent Bordeaux F2K, Hello Bordeaux BL, bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, Dioxane Violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide and lithopone. These may be used alone or in combination of two or more.

A content of the colorant is not particularly restricted, and it may be appropriately selected according to purpose. Nonetheless, with respect to 100 parts by mass of the toner, it is preferably 1 part by mass to 15 parts by mass, and more preferably 3 parts by mass to 10 parts by mass The colorant may also be used as a masterbatch combined with a resin.

Examples of the resin include: the non-crystalline polyester resin B, and polymers of styrene or substituents thereof such as polystyrene, poly-p-chlorostyrene and polyvinyltoluene; styrene copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-methyl chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer and styrene-maleic acid ester copolymer; polymethyl methacrylate, polybutyl methacrylate, polyvinyl chloride, polyvinyl acetate, polyethylene, polypropylene, an epoxy resin, an epoxy polyol resin, polyurethane, polyamide, polyvinyl butyral, polyacrylic acid, rosin, modified rosin, a terpene resin, an aliphatic or alicyclic hydrocarbon resin and an aromatic petroleum resin. These may be used alone or in combination of two or more.

The masterbatch may be obtained by mixing and kneading the resin for masterbatch and the colorant with an application of a high shear force. At this time, an organic solvent may be used in order to enhance the interaction between the colorant and the resin for masterbatch. Also, it is preferable to produce the masterbatch by a so-called flushing method. The flushing method is to knead an aqueous paste of a colorant with a resin and an organic solvent to migrate the colorant to the resin and then to remove the water and the organic solvent. With this method, a wet cake of the colorant may be directly used, and there is no need to dry. In mixing and kneading, a high-shear dispersing apparatus such as three-roll mill is preferably used.

<Other Components>

The other components are not particularly restricted, and they may be appropriately selected according to purpose. Examples thereof include a releasing agent, a charge controlling agent, an external additive, a fluidity improving agent, a cleanability improving agent and a magnetic material.

—Releasing Agent—

The releasing agent is not particularly restricted, and it may be appropriately selected according to purpose. Nonetheless, waxes are preferable.

Examples of the waxes include natural waxes, synthetic waxes and other waxes.

Examples of the natural waxes include: vegetable waxes such as carnauba wax, cotton wax, Japan wax and rice wax; animal waxes such as bees wax and lanolin; mineral waxes such as ozokerite and ceresin; and petroleum waxes such as paraffin, microcrystalline wax and petrolatum.

Examples of the synthetic waxes include: synthetic hydrocarbon waxes such as fischer-tropsch wax, polyethylene and polypropylene; fat and oil-based synthetic waxes such as esters, ketones and ethers; and hydrogenated wax.

Examples of the other waxes include: fatty acid amide compounds such as 12-hydroxystearic amide, stearic amide, phthalic anhydride imide and chlorinated hydrocarbons; homopolymers or copolymers of polyacrylate as a low-molecular-weight crystalline polymeric resin such as poly-n-stearyl methacrylate and poly-n-lauryl methacrylate (e.g., a copolymer of n-stearyl acrylate-ethyl methacrylate and so on) and a crystalline polymeric resin having a long alkyl group in a side chain thereof.

These releasing agents may be used alone or in combination of two or more.

Among these, the paraffin wax, the microcrystalline wax, and the hydrocarbon wax such as fischer-tropsch wax, polyethylene wax and polypropylene wax are preferable.

A melting point of the releasing agent is not particularly restricted, and it may be appropriately selected according to purpose. Nonetheless, it is preferably 60° C. to 80° C. When the melting point is less than 60° C., the releasing agent is likely to melt at a low temperature, which may degrade heat-resistant storage stability. When the melting point exceeds 80° C., the releasing agent does not sufficiently melt and causes a high-temperature offset during fixing even though the resin melts and is in a fixing temperature region. As a result, there are cases an image defect occurs.

A content of the releasing agent is not particularly restricted, and it may be appropriately selected according to purpose. Nonetheless, with respect to 100 parts by mass of the toner, it is preferably 2 parts by mass to 10 parts by mass, and more preferably 3 parts by mass to 8 parts by mass. When the content is less than 2 parts by mass, there are cases where high temperature-resistant offset property and low-temperature fixing property during fixing degrade. When it exceeds 10 parts by mass, there are cases where heat-resistant storage stability degrades or image fogging easily occurs. The content within the more preferable range is advantageous in view of enhancing high image quality and improving fixing stability.

—Charge Controlling Agent—

The charge controlling agent is not particularly restricted, and it may be appropriately selected according to purpose. Examples thereof include nigrosine dyes, triphenylmethane dyes, chromium-containing metal complex dyes, molybdic acid chelate pigments, rhodamine dyes, alkoxy amines, quaternary ammonium salt (including fluorine-modified quaternary ammonium salts), alkyl amides, elemental phosphorus or phosphorus compound, elemental tungsten or tungsten compounds, fluorine surfactants, metal salts of salicylic acid, and metal salts of salicylic acid derivatives.

Commercial products may be used as the charge controlling agent, and examples of the commercial products include: BONTRON 03 of nigrosine dyes, BONTRON P-51 of quaternary ammonium salt, BONTRON S-34 of metal-containing azo dye, E-82 of oxynaphthoic acid metal complex, E-84 of salicylic acid metal complex, and E-89 of phenol condensate (all manufactured by Orient Chemical Industries Co., Ltd.); TP-302 and TP-415 of quaternary ammonium salt molybdenum complexes (all manufactured by Hodogaya Chemical Co., Ltd.); LRA-901, and LR-147 as a boron complex (manufactured by Carlit Japan Co., Ltd.); copper phthalocyanine, perylene, quinacridone, azo pigments and other polymeric compounds having a functional group such as sulfonic acid group, carboxyl group and quaternary ammonium salt. These may be used alone or in combination of two or more.

The charge controlling agent may be melt-kneaded along with the masterbatch and the resin and then dissolved or dispersed. Also, it may be directly added to the organic solvent during dissolution or dispersion, or it may be externally added to a surface of the toner after toner base particles are prepared.

A content of the charge controlling agent is not particularly restricted, and it may be appropriately selected according to purpose. Nonetheless, with respect to 100 parts by mass of the toner, it is preferably 0.1 parts by mass to 10 parts by mass, and more preferably 0.2 parts by mass to 5 parts by mass. When the content exceeds 10 parts by mass, charging property of the toner is excessively large. This weakens an effect of the main charge controlling agent and increases electrostatically attractive force with a developing roller, which may result in reduced fluidity of a developer and reduced image density.

—External Additive—

As the external additive, other than oxide fine particles, inorganic particles or hydrophobized inorganic particles may be used in combination. Nonetheless, the hydrophobized primary particles preferably have an average particle diameter of 1 nm to 100 nm, and the inorganic particles having an average particle diameter of 5 nm to 70 nm are more preferable.

Also, it is preferable to include at least one type of inorganic particles having an average particle diameter of hydrophobized primary particles of 20 nm or less and at least one type of inorganic particles of 30 nm or greater. Also, a BET specific surface area is preferably 20 $m^2/g$ to 500 $m^2/g$.

The external additive is not particularly restricted, and it may be appropriately selected according to purpose. Examples thereof include silica particles, hydrophobic silica, fatty acid metal salts (e.g., zinc stearate, aluminum stearate and so on), metal oxides (e.g., titania, alumina, tin oxide, antimony oxide and so on) and fluoropolymers. These may be used alone or in combination of two or more.

Examples of the external additive include silica particles, hydrophobized silica particles, titania particles, hydrophobized titanium oxide particles and alumina particles.

Commercial products may be used as the silica particles, and examples of the commercial products include R972, R974, RX200, RY200, R202, R805, R812 (all manufactured by Nippon Aerosil Co., Ltd.).

Commercial products may be used as the titania particles, and examples of the commercial products include: P-25 (manufactured by Nippon Aerosil Co., Ltd.); STT-30 and STT-65C-S (all manufactured by Titan Kogyo, Ltd.); TAF-140 (manufactured by Fuji Titanium Industry Co., Ltd.); and MT-150W, MT-500B, MT-600B and MT-150A (all manufactured by Tayca Corporation).

Commercial products may be used as the hydrophobized titanium oxide fine particles and examples of the commercial products include; T-805 (manufactured by Nippon Aerosil Co., Ltd.); STT-30A and STT-65S-S (all manufactured by Titan Kogyo, Ltd.); TAF-500T and TAF-1500T manufactured by Fuji Titanium Industry Co., Ltd.); MT-100S and MT-100T (all manufactured by Tayca Corporation); and ITS (manufactured by Ishihara Sangyo Kaisha Ltd.).

The hydrophobized oxide fine particles, the hydrophobized silica particles, the hydrophobized titania particles and the hydrophobized alumina fine particles may be obtained, for example, by treating hydrophilic fine particles with a silane coupling agent such as methyltrimethoxysilane, methyltriethoxysilane and octyltrimethoxysilane.

Also, silicone oil-treated inorganic particles obtained by processing inorganic particles with silicone oil with heating according to necessity are favorable.

Examples of the silicone oil include dimethylsilicone oil, methylphenylsilicone oil, chlorophenylsilicone oil, methylhydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, methacryl-modified silicone oil and α-methylstyrene-modified silicone oil.

Examples of the inorganic particles include silica, alumina, titanium oxide, barium titanate, magnesium titanate, calcium titanate, strontium titanate, iron oxide, copper oxide, zinc oxide, tin oxide, silica sand, clay, mica, wollastonite, diatomaceous earth, chromium oxide, cerium oxide, colcothar, antimony trioxide, magnesium oxide, zirconium oxide, barium sulfate, barium carbonate, calcium carbonate, silicon carbide and silicon nitride. These may be used alone or in combination of two or more. Among these, silica and titanium dioxide are particularly preferable.

A content of the external additive is not particularly restricted, and it may be appropriately selected according to purpose. Nonetheless, with respect to 100 parts by mass of the toner, it is preferably 0.1 parts by mass to 5 parts by mass, and more preferably 0.3 parts by mass to 3 parts by mass.

An average particle diameter of primary particles of the inorganic particles is not particularly restricted, may be appropriately selected according to purpose. Nonetheless, it is preferably 100 nm or less, and more preferably 3 nm to 70 nm. When the average particle diameter is less than 3 nm, the inorganic particles are embedded in the toner, and there are cases where functions thereof are not effectively exhibited. The diameter exceeding 100 nm may cause non-uniform scratches on a surface of a photoconductor.

—Fluidity Improving Agent—

The fluidity improving agent is not particularly restricted as long as it enhances hydrophobicity by surface treatment and prevents degradation of fluidity properties and charge properties under high-humidity, and it may be appropriately selected according to purpose. Examples thereof include a silane coupling agent, a silylating agent, a silane coupling agent having a fluorinated alkyl group, an organic titanate coupling agent, an aluminum-based coupling agent, silicone oil and modified silicone oil. It is particularly preferable that the silica and the titanium oxide as the external additive are subjected to surface treatment by the fluidity improving agent and used as hydrophobic silica and hydrophobic titanium oxide.

—Cleanability Improving Agent—

The cleanability improving agent is not particularly restricted as long as it is added to the toner for removing the toner remaining on a photoconductor and an intermediate transfer member after transfer, and it may be appropriately selected according to purpose. Examples thereof include: fatty acid metal salt such as zinc stearate, calcium stearate and stearic acid; and polymer fine particles manufactured by soap-free emulsion polymerization such as polymethyl methacrylate fine particles and polystyrene fine particles. The polymer fine particles preferably have a relatively narrow particle size distribution, and a volume-average particle diameter thereof is more preferably 0.01 μm to 1 μm.

—Magnetic Material—

The magnetic material is not particularly restricted, and it may be appropriately selected according to purpose. Examples thereof include iron powder, magnetite and ferrite. Among these, a white material is preferable in view of color tone.

<Toner Manufacturing Method>

The toner manufacturing method is not particularly restricted, and it may be appropriately selected according to purpose. Nonetheless, a method of dispersing an oil phase including the crystalline resin A, the non-crystalline resin B, the resin E and the colorant and further including other components such as releasing agent according to necessity in an aqueous medium for granulation is preferable. Favorable examples of the toner manufacturing method include a dissolution-suspension method.

The dissolution-suspension method preferably includes preparation of an aqueous medium, preparation of an oil phase including a toner material, emulsification or dispersion of the toner material and removal of an organic solvent.

—Preparation of Aqueous Medium (Aqueous Phase)—

The aqueous medium may be prepared, for example, by dispersing resin particles in an aqueous medium. An added amount of the resin particles in the aqueous medium is not particularly restricted, and it may be appropriately selected according to purpose. Nonetheless, with respect to 100 parts by mass of the aqueous medium, it is preferably 0.5 parts by mass to 10 parts by mass.

The aqueous medium is not particularly restricted, and it may be appropriately selected according to purpose. Examples thereof include water, a solvent miscible with water, and mixtures thereof. These may be used alone or in combination of two or more. Among these, water is preferable.

The solvent miscible with water is not particularly restricted, and it may be appropriately selected according to purpose. Examples thereof include alcohols, dimethylformamide, tetrahydrofuran, cellosolves and lower ketones. The alcohols are not particularly restricted, and they may be appropriately selected according to purpose. Examples thereof include methanol, isopropanol and ethylene glycol. The lower ketones are not particularly restricted, and they may be appropriately selected according to purpose. Examples thereof include acetone and methyl ethyl ketone.

—Preparation of Oil Phase—

An oil phase including the toner material may be prepared by dissolving or dispersing in an organic solvent a toner material including the crystalline resin A, the non-crystalline resin B and the resin E, including the colorant and further including other components such as releasing agent according to necessity.

The organic solvent is not particularly restricted, and it may be appropriately selected according to purpose. Nonetheless, the organic solvent having a boiling point of less than 150° C. is preferable for easy removal.

The organic solvent having a boiling point of less than 150° C. is not particularly restricted, and it may be appropriately selected according to purpose. Examples thereof include toluene, xylene, benzene, carbon tetrachloride, methylene chloride, 1,2-dichloroethane, 1,1,2-trichloroethane, trichlorethylene, chloroform, monochlorobenzene, dichloroethylidene, methyl acetate, ethyl acetate, methyl ethyl ketone and methyl isobutyl ketone. These may be used alone or in combination of two or more.

Among these, ethyl acetate, toluene, xylene, benzene, methylene chloride, 1,2-dichloroethane, chloroform and carbon tetrachloride are preferable, and ethyl acetate is more preferable.

—Emulsification or Dispersion—

Emulsification or dispersion of the toner material may be carried out by dispersing the oil phase including the toner material in the aqueous medium.

A method for stably forming the dispersion liquid in the aqueous medium is not particularly restricted, and it may be appropriately selected according to purpose. Examples thereof include a method of adding an oil phase prepared by dissolving or dispersing a toner material in a solvent into an aqueous medium phase and dispersing it by a shearing force.

A dispersing machine for the dispersion is not particularly restricted, and it may be appropriately selected according to purpose. Examples thereof include a low-speed shearing disperser, a high-speed shearing disperser, a frictional disperser, a high-pressure jet disperser and an ultrasonic disperser. Among these, the high-speed shearing disperser is preferable since it allows controlling a particle diameter of the dispersion (oil droplets) to 2 μm to 20 μm.

When the high-speed shearing disperser is used, conditions such as rotational speed, dispersion time and dispersion temperature are not particularly restricted, and they may be appropriately selected according to purpose.

The rotational speed is not particularly restricted, and it may be appropriately selected according to purpose. Nonetheless, it is preferably 1,000 rpm to 30,000 rpm, and more preferably 5,000 rpm to 20,000 rpm.

The dispersion time is not particularly restricted, may be appropriately selected according to purpose. Nonetheless, for a batch operation, it is preferably 0.1 minutes to 5 minutes.

The dispersion temperature is not particularly restricted, may be appropriately selected according to purpose. Nonetheless, under an increased pressure, it is preferably 0° C. to 150° C., and more preferably 40° C. to 98° C. Here, in general, dispersion is easier when the dispersion temperature is higher.

An amount of the aqueous medium used in emulsifying or dispersing the toner material is not particularly restricted, and it may be appropriately selected according to purpose. Nonetheless, with respect to 100 parts by mass of the toner material, it is preferably 50 parts by mass to 2,000 parts by mass, and more preferably 100 parts by mass to 1,000 parts by mass.

The used amount of the aqueous medium of less than 50 parts by mass may result in poor dispersion of the toner materials, and toner base particles having a predetermined particle diameter may not be obtained. The used amount exceeding 2,000 parts by mass may result in elevated production cost.

When the oil phase including the toner material is emulsified or dispersed, it is preferable to use a dispersant in view of stabilizing the dispersant such as oil droplets to form them in a desired shape as well as narrowing particle size distribution thereof.

The dispersant is not particularly restricted, and it may be appropriately selected according to purpose. Examples thereof include a surfactant, an inorganic compound dispersant which is hardly water soluble and polymeric protective colloid. These may be used alone or in combination of two or more. Among these, the surfactant is particularly preferable.

Examples of the surfactant include an anionic surfactant, a cationic surfactant, a nonionic surfactant and an amphoteric surfactant.

Examples of the anionic surfactant include alkylbenzene sulfonate, α-olefinsulfonate, phosphoric acid esters and anionic surfactants containing a fluoroalkyl group. Among these, the anionic surfactants containing a fluoroalkyl group is preferable. Examples of the anionic surfactants containing a fluoroalkyl group include fluoroalkyl carboxylic acids having 2 to 10 carbon atoms and metal salts thereof, disodium perfluorooctanesulfonylglutamate, sodium 3-[ω-fluoroalkyl (C6 to C11)oxy)-1-alkyl(C3 or C4) sulfonates, sodium 3-[ω-fluoroalkanoyl(C6 to C8)-N-ethylamino]-1-propanesulfonates, fluoroalkyl(C11 to C20) carboxylic acids and metal salts thereof, perfluoroalkylcarboxylic acids(C7 to C13) and metal salts thereof, perfluoroalkyl(C4 to C12)sulfonates and metal salts thereof, perfluorooctanesulfonic acid diethanol amide, N-propyl-N-(2-hydroxyethyl)perfluorooctanesulfone amide, perfluoroalkyl(C6 to C10)sulfonamide propyltrimethylammonium salts, salts of perfluoroalkyl(C6 to C10)-N-ethylsulfonylglycin and monoperfluoroalkyl(C6 to C16) ethylphosphates. These may be used alone or in combination of two or more.

Commercial products may be used as the surfactants containing a fluoroalkyl group. Examples of the commercial products include: SURFLON S-111, S-112 and S-113 (manufactured by Asahi Glass Co., Ltd.); FLUORAD FC-93, FC-95, FC-98 and FC-129 (manufactured by Sumitomo 3M Ltd.); UNIDYNE DS-101 and DS-102 (manufactured by Daikin Industries, Ltd.); MEGAFACE F-110, F-120, F-113, F-191, F-812 and F-833 (manufactured by DIC Corporation); EFTOP EF-102, 103, 104, 105, 112, 123A, 123B, 306A, 501, 201 and 204 (manufactured by Tochem Products Inc.); and FTERGENT F-100 and F150 (manufactured by Neos Company Ltd.). These may be used alone or in combination of two or more.

Examples of the cationic surfactant include amine salt surfactants, quaternary ammonium salt cationic surfactants and cationic surfactants containing a fluoroalkyl group. Examples of the amine salt surfactants include alkylamine salts, aminoalcohol fatty acid derivatives, polyamine fatty acid derivatives and imidazoline. Examples of the quaternary ammonium salt cationic surfactants include alkyltrimethyl ammonium salts, dialkyldimethyl ammonium salts, alkyldimethylbenzyl ammonium salts, pyridinium salts, alkylisoquinolinium salts and benzethonium chloride. Examples of the cationic surfactants containing a fluoroalkyl group include an aliphatic primary, secondary or tertiary amine acid having a fluoroalkyl group, an aliphatic quaternary ammonium salt such as perfluoroalkyl(C6-C10)sulfonamidepropyltrimethyl ammonium salt, a benzalkonium salt, benzethonium chloride, a pyridinium salt and an imidazolinium salt. These may be used alone or in combination of two or more.

Commercial products may be used as the cationic surfactants, and examples of the commercial products include: SURFLON S-121 (manufactured by Asahi Glass Co., Ltd.); FLUORAD FC-135 (manufactured by Sumitomo 3M Ltd.); UNIDYNE DS-202 (manufactured by Daikin Industries, Ltd.), MEGAFACE F-150 and F-824 (manufactured by DIC Corporation); EFTOP EF-132 (manufactured by Tochem Products Inc.); and FTERGENT F-300 (manufactured by Neos Company Ltd.). These may be used alone or in combination of two or more.

Examples of the nonionic surfactant include fatty acid amide derivatives and polyhydric alcohol derivatives.

Examples of the amphoteric surfactant include alanine, dodecyldi(aminoethyl)glycine, di(octylamioethyl)glycine and N-alkyl-N,N-dimethyl ammonium betaine.

—Removal of Organic Solvent—

A method for removing the organic solvent from the dispersion liquid such as emulsified slurry is not particularly restricted, and it may be appropriately selected according to purpose. Examples thereof include: a method of evaporating the organic solvent in the oil droplets by gradually heating the entire reaction system; and a method of removing the organic solvent in the oil droplets by spraying the dispersion liquid in a dry atmosphere.

Once the organic solvent is removed, toner base particles are formed. The toner base particles can be subjected to washing and drying and further to classification. The classification can be carried out by removing a portion of fine particles in a liquid by means of a cyclone, a decanter, a centrifuge and so on, or a classification operation can be carried out after drying.

The obtained toner base particles can be mixed with particles such as external additive and charge controlling agent above. At this time, application of a mechanical impact can suppress departure of particles such as external additive from a surface of the toner base particles.

A method for applying the mechanical impact is not particularly restricted, and it may be appropriately selected according to purpose. Examples thereof include: a method of applying an impact on the mixture using a blade rotating at high speed; and a method of having the mixture collide against a collision plate by placing the mixture in a high-speed flow current for acceleration.

An apparatus used for the method is not particularly restricted, and it may be appropriately selected according to purpose Examples thereof include ANGMILL (manufactured by Hosokawa Micron Co., Ltd.), a remodeled apparatus of I-TYPE MILL with a reduced grinding air pressure (manufactured by Nippon Pneumatic Mfg. Co., Ltd.), HYBRIDIZATION SYSTEM (manufactured by Nara Kikai Seisakusho Co., Ltd.), KRYPTRON SERIES (manufactured by Kawasaki Heavy Industries, Ltd.) and an automatic mortar.

A shape, a size and so on of the toner of the present invention are not particularly restricted and may be appropriately selected according to purpose. A volume-average particle diameter of the toner is not particularly restricted, and it may be appropriately selected according to purpose. Nonetheless, it is preferably 3 μm to 7 μm. Also, a ratio (Dv/Dn) of a number-average particle diameter Dn to the volume-average particle diameter Dv of the toner is preferably 1.2 or less. Further, it is preferable to include 1% by number to 10% by number of particles having a particle diameter of 2 μm or less.

Coloring of the toner is not particularly restricted, and it may be appropriately selected according to purpose. It may be at least one type selected from a black toner, a cyan toner, a magenta toner and a yellow toner, and the toners of the respective colors may be obtained by appropriately selecting a type of the colorant.

<<Calculation Method and Analysis Method of Various Properties of Toner and Toner Components>>

A glass transition temperature Tg, an acid value, a hydroxyl value, a molecular weight and a melting point of the crystalline resin A, the non-crystalline resin B and the resin E having the crystalline portion C and the non-crystalline portion D in a molecule thereof are not particularly restricted, and they may be appropriately selected according to purpose. These may be measured per se. However, these may be separated from an actual toner by gel permeation chromatography (GPC) and so on, and an SP value, the Tg, the molecular weight, the melting point and a mass ratio of the components of the separated components may be calculated by analysis techniques described later.

Here, the separation of the components by GPC may be carried out, for example, by the following method.

In a GPC measurement with THF (tetrahydrofuran) as a mobile phase, an eluate is fractionated by a fraction collector, etc., and in the entire area of an elusion curve, a fractions corresponding to a desired molecular-weight portion is collected.

The collected eluate is concentrated and dried by an evaporator, and a solid content is dissolved in a deuterated solvent such as deuterated chloroform and deuterated THF. Thereafter, a $^{1}$H-NMR measurement is carried out, and from an integration ratio of each element, it is possible to calculate the ratio of monomers constituting the resin in the eluted component.

Also, as another method, after the eluate is concentrated and then hydrolyzed by sodium hydroxide and so on. A decomposition product thereof is subjected to qualitative and quantitative analyses by high-speed liquid chromatography (HPLC) and so on. Thereby, the constitutional monomer ratio may be calculated.

<<Method for Separating Toner Component>>

One example of a separation method of components in analyzing the toner is described below.

First, 1 g of the toner is placed in 100 mL of tetrahydrofuran (THF) and dissolved by stirring for 30 minutes under a condition of 25° C., and a solution in which soluble components are dissolved is obtained.

This is filtered by a membrane filter having openings of 0.2 μm, and a THF soluble matter in the toner is obtained.

Next, this is dissolved in THF as a sample for GPC measurement and injected in a GPC used for measuring molecular weights of the above-described resins.

Meanwhile, a fraction collector is arranged at an eluate outlet of the GPC. An eluate is fractionated at every predetermined count, and an eluate is obtained at every 5% as an area ratio from the beginning of the elusion of an elusion curve (rise of the curve).

Next, for each elusion, 30 mg of the sample is dissolved in 1 mL of deuterated chloroform, to which 0.05% by volume of tetramethylsilane (TMS) is added as a reference substance.

The solution is filled in a glass tube for NMR measurement having a diameter of 5 mm, and using a nuclear magnetic resonator (manufactured by JEOL Ltd., JNM-AL400), integrations are carried out 128 times at a temperature of 23° C. to 25° C. to obtain a spectrum.

The monomer compositions and the compositional ratio of the crystalline resin A, the non-crystalline resin B, the resin E and so on included in the toner may be obtained from peak integration ratio of the obtained spectrum.

From these results, for example, an extract collected in a fraction in which the crystalline resin A accounts for 90% or greater may be treated as the crystalline resin A. Similarly, an extract collected in a fraction in which the non-crystalline resin B accounts for 90% or greater may be treated as the non-crystalline resin B. Also similarly, an extract collected in a fraction in which the resin E accounts for 90% or greater may be treated as the resin E.

The toner of the present invention does not cause filming and has superior properties such as low-temperature fixing property, high temperature-resistant offset property and heat-resistant storage stability. Thus, the toner of the present invention may be favorably used in various fields, may be favorably used for image formation by electrophotography, and may be favorably used for a developer of the present invention, a toner container used in the present invention, a process cartridge used in the present invention, an image forming apparatus of the present invention and an image forming method used in the present invention described below.

(Developer)

A developer of the present invention includes the toner of the present invention, and it includes other components such as carrier appropriately selected according to necessity.

Thus, it has superior transfer property, charging property and so on, and it is possible to stably form a high-quality image. Here, the developer may be a one-component developer or a two-component developer. Nonetheless, the two-component developer is preferable because it improves the life when it is used for a high-speed printer compatible with improved information processing speed in recent years.

When the developer is used as a one-component developer, variation of the particle diameter of the toner is small even after the toner is balanced, and moreover, it does not cause filming on a developing roller or fuse on a member such as blades which thins the toner, and favorable and stable developing property and images may be achieved after a long-term stirring in the developing apparatus.

When the developer is used as a two-component developer, variation of the particle diameter of the toner is small when the toner in the developer is balanced over a long period of time, and favorable and stable developing property and images may be achieved after a long-term stirring in a developing apparatus.

<Carrier>

The carrier is not particularly restricted, and it may be appropriately selected according to purpose. Nonetheless, the carrier preferably includes a core material and a resin layer which coats the core material.

—Core Material—

A material of the core material is not particularly restricted, and it may be appropriately selected according to purpose. Examples thereof include a manganese-strontium material of 50 emu/g to 90 emu/g and a manganese-magnesium material of 50 emu/g to 90 emu/g. Also, to ensure image density, it is preferable to use a high-magnetization material such as iron powder of 100 emu/g or greater and magnetite of 75 emu/g to 120 emu/g. Also, it is preferable to use a low magnetization material such as copper-zinc of 30 emu/g to 80 emu/g since it can ease an impact of the developer as a chain of magnetic particles to the photoconductor and it is advantageous for high image quality. These may be used alone or in combination of two or more.

A volume-average particle diameter of the core material is not particularly restricted, and it may be appropriately selected according to purpose. Nonetheless, it is preferably 10 μm to 150 μm, and more preferably 40 μm to 100 μm. When the volume-average particle diameter is less than 10 μm, fine powder increases in the carrier particles, and magnetization per one particle may decrease. This may result in carrier scattering. When it exceeds 150 μm, specific surface area decreases, which may result in toner scattering. In a full-color printing having many solid portions, reproduction of the solid portions may degrade in particular.

The toner may be mixed with the carrier when it is used for a two-component developer.

A content of the carrier in the two-component developer is not particularly restricted, and it may be appropriately selected according to purpose. Nonetheless, it is preferably 90 parts by mass to 98 parts by mass, and more preferably 93 parts by mass to 97 parts by mass with respect to 100 parts by mass of the two-component developer.

<Toner Container>

A toner container used in the present invention contains the toner or the developer of the present invention in a container.

The container is not particularly restricted, and it may be appropriately selected from heretofore known ones. Favorable examples thereof include a container including a toner container main body and a cap.

A size, a shape, a structure, a material and so on of the toner container main body are not particularly restricted, and they may be appropriately selected according to purpose. For example, as the shape, a cylinder is preferable, and particularly preferable ones have a spiral-shaped asperity formed on an internal surface thereof, which is capable of transferring a toner as content to an outlet side by rotation, where a part or the whole of the spiral portion has a function of bellows.

A material of the toner container main body is not particularly restricted, and ones with high dimension accuracy are preferable. Favorable examples thereof include resins, and among these, polyester resins, polyethylene resins, polypropylene resins, polystyrene resins, polyvinyl chloride resins, polyacrylic acid, polycarbonate resin, ABS resins, polyacetal resins and so on are favorable.

The toner container allows easy storage, transport and so on and is superior in terms of handling, and it may be detachably mounted on a process cartridge, image forming apparatus and so on of the present invention described later and favorably used for replenishing a toner.

<Process Cartridge>

A process cartridge used in the present invention includes: an electrostatic latent image bearing member which supports an electrostatic latent image; and a developing unit which develops the electrostatic latent image supported on the electrostatic latent image bearing member using a toner to form a visible image, and it further includes other units appropriately selected according to necessity.

The developing unit includes: developer container which contains the toner or the developer of the present invention; and a developer bearing member which supports and conveys the toner or the developer in the developer container, and it may further include a layer thickness regulating member for regulating a layer thickness of the supported toner and so on.

The other units are not particularly restricted, and they may be appropriately selected according to purpose. Favorable examples thereof include a charging unit and a cleaning unit described later.

The process cartridge may be detachably mounted on various image forming apparatuses, and preferably, it is detachably mounted on an image forming apparatus of the present invention described later.

(Image Forming Method and Image Forming Apparatus)

An image forming method used in the present invention includes; an electrostatic latent image forming step; a developing step; a transfer step; and a fixing step, and it further includes other steps appropriately selected according to necessity such as neutralizing step, cleaning step, recycling step and controlling step.

The image forming apparatus of the present invention includes an electrostatic latent image bearing member; an electrostatic latent image forming unit; a developing unit; a transfer unit; and a fixing unit, and it further includes other units appropriately selected according to necessity such as neutralizing unit, cleaning unit, recycling unit and controlling unit.

<Electrostatic Latent Image Forming Step and Electrostatic Latent Image Forming Unit>

The electrostatic latent image forming step is a step for forming an electrostatic latent image on the electrostatic latent image bearing member.

A material, a shape, a structure and a size of the electrostatic latent image bearing member (it may also be referred to as an "electrophotographic photoconductor", a "photoconductor" or an "image bearing member") are not particularly restricted, and it may be appropriately selected from heretofore known ones. Nonetheless, the shape is preferably a drum, and as the material, an inorganic photoconductor of amorphous silicon, selenium and so on and an organic photoconductor (OPC) of polysilane, phthalopolymethine and so on are exemplified.

The electrostatic latent image is formed by uniformly charging a surface of the electrostatic latent image bearing member followed by image-wise exposure, and it may be carried out by the electrostatic latent image forming unit.

The electrostatic latent image forming unit includes, for example, a charger which uniformly charges the surface of the electrostatic latent image bearing member and an exposure device which carries out an image-wise exposure on the surface of the electrostatic latent image bearing member.

The charging may be carried out by applying a voltage on the surface of the electrostatic latent image bearing member using the charger.

The charger is not particularly restricted, and it may be appropriately selected according to purpose. Nonetheless, examples thereof include: a contact charger equipped with an electrically conductive or semiconductive roller, brush, film, rubber blade and so on heretofore known per se; and a non-contact charger which uses corona discharge such as corotron and scorotron.

Also, it is preferable that the charger is arranged on an electrostatic latent image bearing member in a contact or non-contact state and charges a surface of the electrostatic latent image bearing member by applying superimposed DC and AC voltages.

It is also preferable that the charger is a charging roller arranged closely to the electrostatic latent image bearing member via a gap tape in a non-contact manner and applies superimposed DC and AC voltages on the charging roller to charge the surface of the electrostatic latent image bearing member.

The exposure may be carried out, for example, by image-wise exposure of a surface of the electrostatic latent image bearing member using the exposure device.

The exposure device is not particularly restricted as long as it can expose imagewise an image to be formed on the surface of the electrostatic latent image bearing member charged by the charger, and it may be selected appropriately according to purpose. Examples thereof include various exposure devices such as duplication optical system, rod lens array system, laser optical system and liquid-crystal shutter optical system.

Here, in the present invention, a back light system which exposes imagewise from a back side of the electrostatic latent image bearing member may be adopted.

<Developing Step and Developing Unit>

The developing step is a step for developing the electrostatic latent image using the toner of the present invention to form a visible image.

The visible image is formed, for example, by developing the electrostatic latent image using the toner of the present invention, and it may be carried out by the developing unit.

The developing unit is not particularly restricted as long as the development is carried out using the toner of the present invention, for example, and it may be appropriately selected from heretofore known ones. For example, a favorable developing unit contains the toner of the present invention or a developer and includes a developing device capable of imparting the developer to the electrostatic latent image in a contact or non-contact manner.

The developing device may employ a dry developing system or a wet developing system. The developing device may be a developing device for a single color, or a developing device for multicolor. Examples thereof include a developing device containing a stirrer for rubbing and stirring to charge the developer and a rotatable magnet roller.

The toner and the carrier are mixed and stirred in the developing device, for example. The toner is charged by a friction thereby and maintained on a surface of the rotating magnet roller as a chain of magnetic particles, and a magnetic brush is formed. The magnet roller is arranged near the electrostatic latent image bearing member, and thus a part of the toner which constitutes the magnetic brush formed on the surface of the magnet roller moves to the surface of the electrostatic latent image bearing member due to an electrically attractive force. As a result, the electrostatic latent image is developed by the toner, and a visible image is formed on the surface of the electrostatic latent image bearing member.

<Transfer Step and Transfer Unit>

The transfer step is a step for transferring the visible image to a recording medium. A preferable aspect employs an intermediate transfer member. The visible image is primarily transferred on the intermediate transfer member, and the visible image is secondarily transferred on the recording medium. A more preferable aspect employs a toner of two or more colors, or preferably a full-color toner, as the toner and includes a primary transfer step in which the visible image is transferred on the intermediate transfer member to form a composite transfer image and a secondary transfer step in which the composite transfer image is transferred on the recording medium.

The transfer may be carried out, for example, by charging the visible image using transfer charger, and it may be carried out by the transfer unit. As the transfer unit, an aspect including a primary transfer unit which transfers the visible image on the intermediate transfer member to form the composite transfer image and a secondary transfer unit which transfers the composite transfer image on the recording medium is preferable.

Here, the intermediate transfer member is not particularly restricted, and it may be appropriately selected from heretofore known transfer members according to purpose, and examples thereof include a transfer belt.

The transfer unit (the primary transfer unit, the secondary transfer unit) preferably includes a transfer device which peels off and charges the visible image formed on the electrostatic latent image bearing member to the side of the recording medium. There may be one transfer unit, or there may be two or more transfer units.

Examples of the transfer device include a corona transfer device by corona discharge, a transfer belt, a transfer roller, a pressure transfer roller and an adhesive transfer device.

Here, the recording medium is not particularly restricted, and it may be appropriately selected from heretofore known recording paper.

<Fixing Step and Fixing Unit>

The fixing step is a step of fixing the visible image transferred to the recording medium using a fixing unit. It may be carried each time the toner of a respective color is transferred on the recording medium, or it may be carried out once at the same time when the toners of respective colors are laminated.

The fixing unit is not particularly restricted, and it may be appropriately selected according to purpose. Nonetheless, a heretofore known heating and pressurizing unit is preferable. Examples of the heating and pressurizing unit include a combination of a heat roller and a pressure roller and a combination of a heat roller, a pressure roller and an endless belt.

The fixing unit preferably includes: a heating body equipped with a heating element; a film which is in contact with the heating body; and a pressure member which is pressed against the heating body via the film. It is preferably a unit which passes the recording medium on which a non-fixed image is formed between the film and the pressure member to fix by heating. Usually, the heating in the heating and pressurizing unit is preferably at 80° C. to 200° C.

<Other Steps and Other Units>

—Neutralizing Step and Neutralizing Unit—

The neutralizing step is a step for applying a neutralizing bias on the electrostatic latent image bearing member for neutralization, and it may be favorably carried out by a neutralizing unit.

The neutralizing unit is not particularly restricted as long as it can apply the neutralizing bias on the electrostatic latent image bearing member. It may be appropriately selected from heretofore known neutralizing devices, and examples thereof include a neutralizing lamp.

—Cleaning Step and Cleaning Unit—

The cleaning step is a step for removing the toner remaining on the electrostatic latent image bearing member, and it may be favorably carried out by a cleaning unit.

The cleaning unit is not particularly restricted as long as it can remove the electrophotographic toner remaining on the electrostatic latent image bearing member. It may be appropriately selected from heretofore known cleaners, and examples thereof include a magnetic brush cleaner, an electrostatic brush cleaner, a magnetic roller cleaner, a blade cleaner, a brush cleaner and a web cleaner.

—Recycling Step and Recycling Unit—

The recycling step is a step for recycling the toner removed by the cleaning step to the developing unit, and it may be favorably carried out by a recycling unit.

The recycling unit is not particularly restricted, and it may be appropriately selected according to purpose. Examples thereof include heretofore known conveying units.

—Controlling Step and Controlling Unit—

The controlling step is a step for controlling the above steps, and it may be favorably carried out by a controlling unit.

The controlling unit is not particularly restricted as long as it can control operations of each of the units, and it may be appropriately selected according to purpose. Examples thereof include devices such as sequencer and computer.

One aspect of implementing the image forming method used in the present invention by the image forming apparatus of the present invention is explained with reference to FIG. 1. An image forming apparatus 100 illustrated in FIG. 1 is equipped with: a photoconductor drum 10 as the electrostatic latent image bearing member (hereinafter, it is referred to as a "photoconductor 10"); a charging roller 20 as the charging unit; an exposure apparatus 30 as the exposure unit; a developing apparatus 40 as the developing unit; an intermediate transfer member 50; a cleaning device 60 as the cleaning unit including a cleaning blade; and a neutralizing lamp 70 as the neutralizing unit.

The intermediate transfer member 50 is an endless belt, and it is designed to be movable in a direction of an arrow in the figure by three (3) rollers 51 which are arranged inside and stretch the member. A part of the three rollers 51 also functions as a transfer bias roller which is capable of applying a predetermined transfer bias (primary transfer bias) to the intermediate transfer member 50. The intermediate transfer member 50 has a cleaning blade 90 for the intermediate transfer member arranged nearby, and it also has a transfer roller 80 as the transfer unit capable of applying a transfer bias for transferring (secondary transfer) a visible image (toner image) to a recording medium 95 arranged facing thereto. Around the intermediate transfer member 50, a corona charger 58 for imparting a charge on a visible image on this intermediate transfer member 50 is arranged between a contact portion of the electrostatic latent image bearing member 10 and the intermediate transfer member 50 and a contact portion of the intermediate transfer member 50 and the recording medium 95 in a direction of rotation of the intermediate transfer member 50.

The developing apparatus 40 is composed of a developing belt 41 as a developer bearing member; and a black developing unit 45K, a yellow developing unit 45Y, a magenta developing unit 45M and a cyan developing unit 45C attached at a periphery of this developing belt 41. Here, the black developing unit 45K is equipped with a developer containing unit 42K, a developer supply roller 43K and a developing roller 44K. The yellow developing unit 45Y is equipped with a developer containing unit 42Y, a developer supply roller 43Y and a developing roller 44Y. The magenta developing unit 45M is equipped with a developer containing unit 42M, a developer supply roller 43M and a developing roller 44M. The cyan developing unit 45C is equipped with a developer containing unit 42C, a developer supply roller 43C and a developing roller 44C. Also, the developing belt 41 is an endless belt rotatably stretched by a plurality of belt rollers, and a portion thereof is in contact with the electrostatic latent image bearing member 10.

In the image forming apparatus 100 illustrated in FIG. 1, for example, the charging roller 20 uniformly charges the photoconductor drum 10. The exposure apparatus 30 carries out an image-wise exposure on the photoconductor drum 10 to form an electrostatic latent image. The electrostatic latent image formed on the photoconductor drum 10 is developed by supplying a toner from the developing apparatus 40, and a visible image (toner image) is formed. The visible image (toner image) is transferred from the roller 51 to the intermediate transfer member 50 by an applied voltage (primary transfer), and it is further transferred on the transfer paper 95 (secondary transfer). As a result, a transfer image is formed on the recording medium 95. Here, a residual toner on the photoconductor 10 is removed by the cleaning device 60, and the charge on the photoconductor 10 is neutralized by the neutralizing lamp 70.

Figure 2:
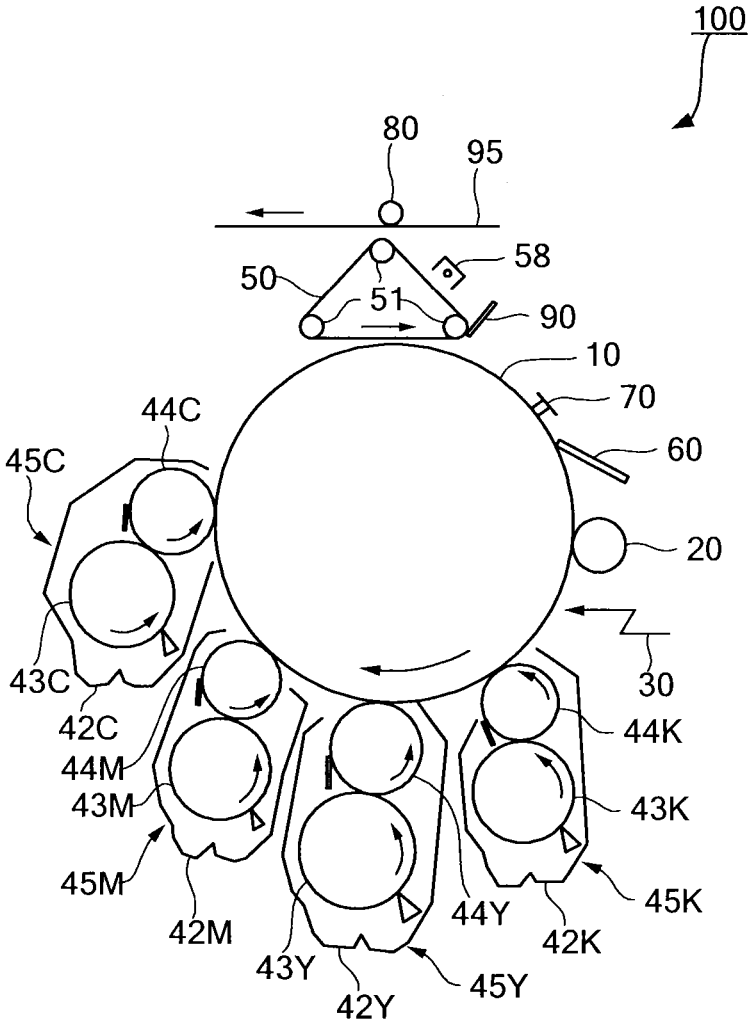
FIG. 2 is a schematic diagram illustrating another example of an image forming apparatus of the present invention.

Another aspect of implementing the image forming method used in the present invention by the image forming apparatus of the present invention is explained with reference to FIG. 2. An image forming apparatus 100 illustrated in FIG. 2 has the same configuration and the same operational effect as the image forming apparatus 100 illustrated in FIG. 1 except that the former is not equipped with the developing belt 41 of the latter and that the black developing unit 45K, the yellow developing unit 45Y, the magenta developing unit 45M and the cyan developing unit 45C are arranged around the photoconductor 10 so as to face directly thereto. Here, elements in FIG. 2 which are the same as those in FIG. 1 are indicated by the same signs.

Figure 3:
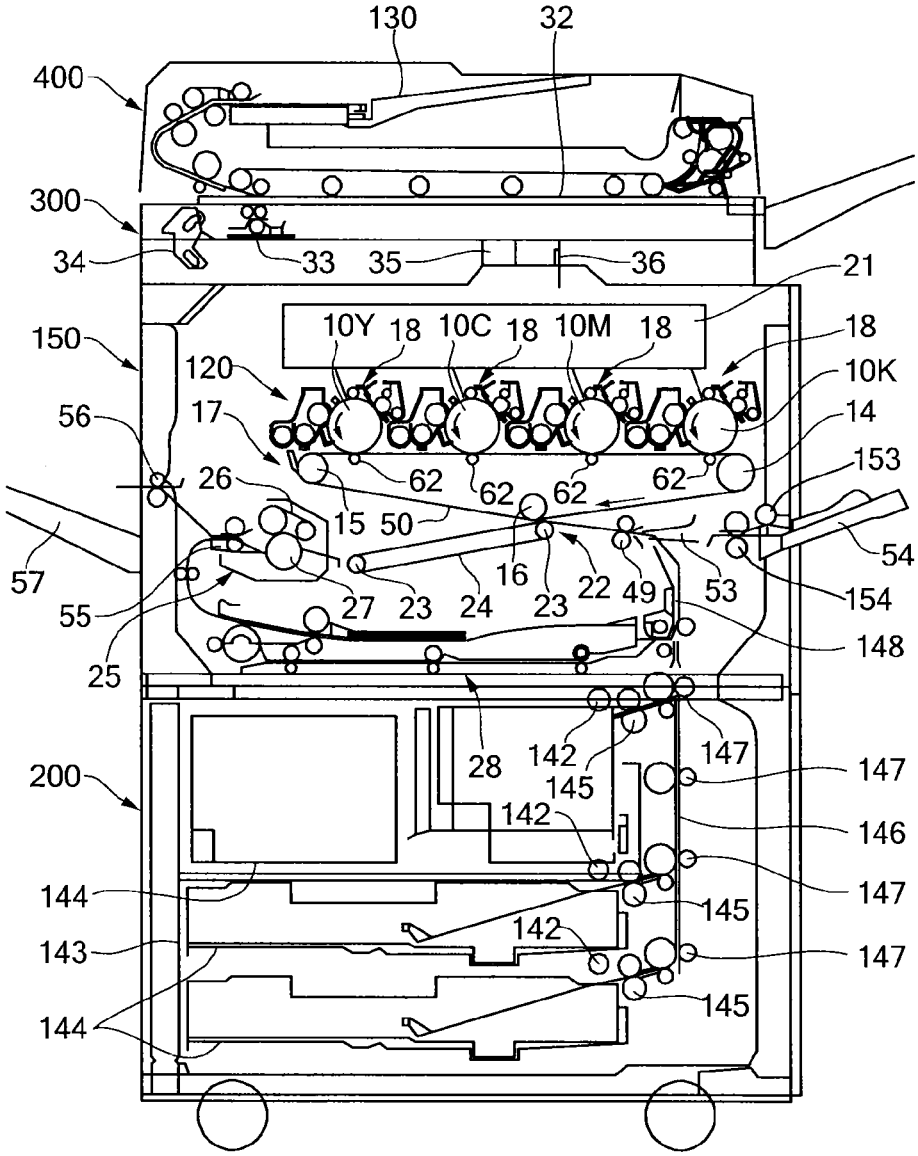
FIG. 3 is a schematic diagram illustrating one example of a tandem color image forming apparatus of the present invention.

Another aspect of implementing the image forming method used in the present invention by the image forming apparatus of the present invention is explained with reference to FIG. 3. A tandem image forming apparatus illustrated in FIG. 3 is a tandem color image forming apparatus. This tandem image forming apparatus is equipped with a copying apparatus main body 150, a paper feed table 200, a scanner 300 and an automatic document feeder (ADF) 400.

In the copying apparatus main body 150, an intermediate transfer member 50 as an endless belt is arranged at a central portion thereof. The intermediate transfer member 50 is stretched by support rollers 14, 15 and 16, and it is rotatable in a clockwise direction in FIG. 3. Near the support roller 15, an intermediate transfer member cleaning device 17 is arranged for removing a residual toner on the intermediate transfer member 50. Along a conveying direction of the intermediate transfer member 50 stretched by the support roller 14 and the support roller 15, a tandem developing device 120 is arranged, in which four (4) image forming units 18 of yellow, cyan, magenta and black are arranged in parallel, facing the intermediate transfer member. Near the tandem developing device 120, an exposure apparatus 21 is arranged. On a side of the intermediate transfer member 50 opposite to the side on which the tandem developing device 120 is arranged, a secondary transfer apparatus 22 is arranged. In the secondary transfer apparatus 22, a secondary transfer belt 24 as an endless belt is stretched by a pair of rollers 23, and a recording medium (transfer paper) conveyed on the secondary transfer belt 24 and the intermediate transfer member 50 can contact with each other. Near the secondary transfer apparatus 22, a fixing apparatus 25 is arranged. The fixing apparatus 25 is equipped with a fixing belt 26 as an endless belt and a pressure roller 27 arranged to be pressed by the fixing belt.

Here, in the tandem image forming apparatus, a sheet inverting apparatus 28 is arranged near the secondary transfer apparatus 22 and the fixing apparatus 25 in order to invert the transfer paper for forming images on both sides of the transfer paper.

Next, formation of a full-color image (color copy) using the tandem developing device 120 is explained. That is, first, a document is placed on a document table 130 of the automatic document feeder (ADF) 400. Alternatively, the automatic document feeder 400, the document is placed on a contact glass 32 of the scanner 300, and the automatic document feeder 400 is closed.

A start switch (not shown) is pressed. The scanner 300 is driven after the document is conveyed onto the contact glass 32 in case the document is placed on the automatic document feeder 400, or immediately in case the document is placed on the contact glass 32, and a first traveling body 33 and a second travelling body 34 travel. At this time, a light from a light source is irradiated by the first traveling body 33, and at the same time, the light reflected from a surface of the document is reflected by a mirror in the second travelling body 34. The light is received by a read sensor 36 through an imaging lens 35. Thereby, the color document (color image) is read as black, yellow, magenta and cyan image information.

Figure 4:
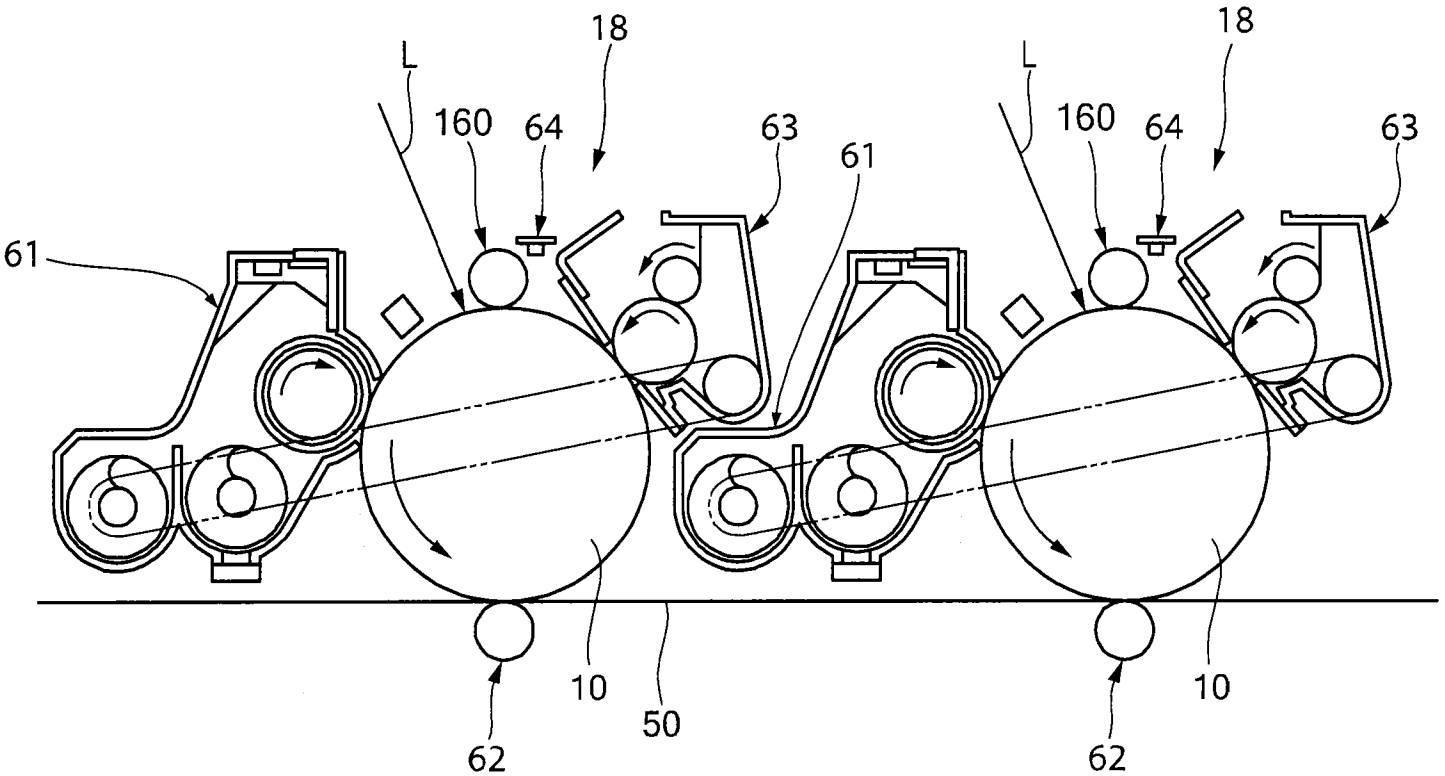
FIG. 4 is a partially enlarged schematic diagram of the image forming apparatus illustrated in FIG. 3.

Then, the black, yellow, magenta and cyan image information are transmitted to the respective image forming units 18 (an image forming unit for black, an image forming unit for yellow, an image forming unit for magenta and an image forming unit for cyan) in the tandem developing device 120, and black, yellow, magenta and cyan toner images are formed in the respective image forming units. That is, the image forming units 18 (the image forming unit for black, the image forming unit for yellow, the image forming unit for magenta and the image forming unit for cyan) in the tandem developing device 120 are respectively equipped with, as illustrated in FIG. 4: electrostatic latent image bearing members 10 (an electrostatic latent image bearing member for black 10K, an electrostatic latent image bearing member for yellow 10Y, an electrostatic latent image bearing member for magenta 10M and an electrostatic latent image bearing member for cyan 10C); charging apparatuses 160, which uniformly charge the respective electrostatic latent image bearing members 10; exposure apparatuses which carries out an imagewise exposure of the electrostatic latent image bearing members corresponding to the respective color image based on the color image information (L in FIG. 4) and forms electrostatic latent images corresponding to the respective color image on the electrostatic latent image bearing member; developing apparatuses 61 which develops the electrostatic latent images using the respective color toners (a black toner, a yellow toner, a magenta toner and a cyan toner) and forms toner images of the respective color toners; transfer chargers 62 for transferring the toner images onto the intermediate transfer member 50; cleaning devices 63; and neutralizing devices 64, and it is capable of forming single-color images of the respective colors based on the image information (a black image, a yellow image, a magenta image and a cyan image). The black image, the yellow image, the magenta image and the cyan image formed thereby, i.e. the black image formed on the electrostatic latent image bearing member for black 10K, the yellow image formed on the electrostatic latent image bearing member for yellow 10Y, the magenta image formed on the electrostatic latent image bearing member for magenta 10M and the cyan image formed on the electrostatic latent image bearing member for cyan 10C are sequentially transferred on the intermediate transfer member 50 which is rotationally moved by the support rollers 14, 15 and 16 (primary transfer). Then, the black image, the yellow image, the magenta image and the cyan image are superimposed on the intermediate transfer member 50, and a composite color image (color transfer image) is formed.

Meanwhile, on the paper feed table 200, one of paper-feed rollers 142 is selectively rotated to feed a sheet (recording paper) from one of paper cassettes 144 provided in multiple stages in a paper bank 143. The sheet is separated one-by-one by separation rollers 145 and sent to a feed path 146. It is conveyed by conveying rollers 147 and guided to a feed path 148 in the copying apparatus main body 150. It stops when it strikes a registration roller 49. Alternatively, a manual paper-feed roller 153 is rotated to feed a sheet (recording paper) on a manual feed tray 54, separated one-by-one by a manual separation roller 154 and fed in a manual feed path 53, and it is stopped similarly when it strikes the registration roller 49. Here, the registration roller 49 is usually grounded in use, or a bias may be applied may be applied in used for removing paper powder of the sheet. Then, the registration roller 49 is rotated to match the timing of the composite color image (color transfer image) formed on the intermediate transfer member 50, the sheet (recording paper) is sent between the intermediate transfer member 50 and the secondary transfer apparatus 22, and the composite color image (color transfer image) is transferred on the sheet (recording paper) by the secondary transfer apparatus 22 (secondary transfer). Thereby, the color image is transferred and formed on the sheet (recording paper). Here, a residual toner on the intermediate transfer member 50 after image transfer is cleaned by the intermediate transfer member cleaning device 17.

The sheet (recording paper) on which the color image has been transferred and formed is conveyed by the secondary transfer apparatus 22 and sent to the fixing apparatus 25, and the composite color image (color transfer image) is fixed on the sheet (recording paper) by heat and pressure in the fixing apparatus 25. Thereafter, the sheet (recording paper) is switched by a switching claw 55, discharged by a discharge roller 56 and stacked on a discharge tray 57. Alternatively, the sheet is switched by the switching claw 55, inverted by a sheet inverting apparatus 28 and guided again to a transfer position. Then, an image is recorded on a back side as well, and it is discharged by the discharge roller 56 and stacked on the discharge tray 57.

Since the toner of the present invention which causes no occurrences of filming and has superior low-temperature fixing property, high temperature-resistant offset property and heat-resistant storage stability is used in the image forming method and the image forming apparatus of the present invention used in the present invention, a high-quality image may be efficiently formed.

EXAMPLES

Hereinafter, the present invention is further described in detail with reference to Examples, which however shall not be construed as limiting the scope of the present invention. Methods for measuring various physical property values of resins used in Examples and Comparative Examples are described below.

<Measurement of Number Average Molecular Weight Mn and Weight-Average Molecular Weight Mw>

A number average molecular weight and a weight-average molecular weight of a resin were measured by GPC (gel permeation chromatography) as follows.

First, a column was stabilized in a heat chamber at 40° C., and tetrahydrofuran (THF) as a solvent was flown in the column at the temperature at a flow rate of 1 ml/min. Then, 50 μL to 200 μL of a THF sample solution of the resin having a sample concentration adjusted to 0.05% by mass to 0.6% by mass was injected, and a measurement was made. In the molecular-weight measurement of the sample, the molecular weight distribution of the sample was calculated from a relation between logarithmic values and a number of counts of a calibration curve created from several types of monodisperse polystyrene standard samples. As the standard polystyrene samples for creating the calibration curve, those having a weight-average molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, $4.48\times10^6$, manufactured by Pressure Chemical Co. Or manufactured by Tosoh Corporation, and at least about 10 standard polystyrene samples were used. An R1 (refractive index) detector was used for a detector.

<Glass Transition Temperature Tg>

A glass transition temperature Tg of a resin was measured using a differential scanning calorimeter (DSC) (Q2000, manufactured by TA Instruments).

First, 5 mg of a toner was sealed in a T-ZERO simple sealing pan, manufactured by TA Instruments, which was set in the apparatus. Regarding the measurement, under a stream of nitrogen, the toner was heated as a first heating from −20° C. to 200° C. at a heating rate of 10° C./min, maintained for 5 minutes, then cooled to −20° C. at a cooling rate of 10° C./min, maintained for 5 minutes, and then heated as a second heating to 200° C. at a heating rate of 10° C./min. Thereby, thermal changes were measured.

As the glass transition temperature Tg, a value obtained by a mid-point method in the analysis programs of the apparatus using the graph of the first heating was used.

(Synthesis Example of Crystalline Resin 1)

—Synthesis of Crystalline Resin 1—

A 5-L four-necked flask equipped with a nitrogen inlet tube, a dehydration tube, a stirrer and a thermocouple was charged with sebacic acid and 1,4-butanediol such that a molar ratio of a hydroxyl group and a carboxyl group (OH/COOH) was 1.2. It was reacted at 180° C. for 10 hours along with titanium tetraisopropoxide (500 ppm by mass with respect to the resin component). It was then reacted for 3 hours at an elevated temperature of 200° C. and further reacted for 2 hours at a pressure of 8.3 kPa. Thereby, [Crystalline Resin 1] was obtained.

Obtained [Crystalline Resin 1] had a weight-average molecular weight of 15,000, a Mw/Mn of 3.0, a melting point of 62° C. and a glass transition temperature of 55° C.

Obtained [Crystalline Resin 1] was measured by an x-ray diffraction method (crystallinity analysis x-ray diffractometer, X'PERT MRD, manufactured by Philips) to determine whether crystallinity is present or absent. An endothermic peak was observed in a range of $20°<2\theta<25°$ from a diffraction peak of an obtained diffraction spectrum, and it was confirmed to have crystallinity.

Measurement conditions of the x-ray diffraction method are described below.

[Measurement Conditions]

Tension kV: 45 kV
Current: 40 mA
MPSS
Upper
Gonio
Scanmode: continuous
Start angle: 3°
End angle: 35°
Angle Step: 0.02°
Lucident beam optics
Divergence slit: Div slit 1/2
Diflection beam optics
Anti scatter slit: As Fixed 1/2
Receiving slit: Prog rec slit (Synthesis Example of Crystalline Resin 2)

—Synthesis of Crystalline Resin 2—

A 5-L four-necked flask equipped with a nitrogen inlet tube, a dehydration tube, a stirrer and a thermocouple was charged with terephthalic acid, 1,5-pentanediol and 1,4-butanediol such that a molar ratio (OH/COOH) of a hydroxyl group and a carboxyl group was 1.2, that an acid component was composed of 100 mol % of terephthalic acid, and that an alcohol component was composed of 50 mol % of 1,5-pentanediol and 50 mol % of 1,4-butanediol. It was reacted at 180° C. for 10 hours along with titanium tetraisopropoxide (500 ppm by mass with respect to the resin component). It was then reacted for 3 hours at an elevated temperature of 200° C.

and further reacted for 2 hours at a pressure of 8.3 kPa. Thereby, [Crystalline Resin 2] was obtained.

Obtained [Crystalline Resin 2] had a weight-average molecular weight Mw of 12,000, Mw/Mn of 4.0, a melting point of 69° C. and a glass transition temperature of 58° C.

A diffraction spectrum of obtained [Crystalline Resin 2] was measured by the x-ray diffraction method in the same manner as the crystalline resin of Synthesis Example 1, and an endothermic peak was observed from a diffraction peak in a range of 20°<2θ<25°. Thus, it was confirmed to have crystallinity (Synthesis Example of Crystalline Resin 3)

—Synthesis of Crystalline Resin 3—

A 5-L four-necked flask equipped with a nitrogen inlet tube, a dehydration tube, a stirrer and a thermocouple was charged with terephthalic acid, 1,6-hexanediol and 1,4-butanediol such that a molar ratio (OH/COOH) of a hydroxyl group to a carboxyl group was 1.2, that an acid component was composed of 100 mol % of terephthalic acid, and that an alcohol component was composed of 50 mol % of 1,6-hexanediol and 50 mol % of 1,4-butanediol. It was reacted at 180° C. for 10 hours along with titanium tetraisopropoxide (500 ppm by mass with respect to the resin component). It was then reacted for 3 hours at an elevated temperature of 200° C. and further reacted for 2 hours at a pressure of 8.3 kPa. Thereby, [Crystalline Resin 3] was obtained.

Obtained [Crystalline Resin 3] had a weight-average molecular weight of 13,000, a Mw/Mn of 4.2, a melting point of 84° C. and a glass transition temperature of 52° C.

A diffraction spectrum of obtained [Crystalline Resin 3] was measured by the x-ray diffraction method in the same manner as the crystalline resin of Synthesis Example 1, and an endothermic peak was observed from a diffraction peak in a range of 20°<2θ<25°. Thus, it was confirmed to have crystallinity. (Synthesis Example of Crystalline Resin 4)

—Synthesis of Crystalline Resin 4—

A 5-L four-necked flask equipped with a nitrogen inlet tube, a dehydration tube, a stirrer and a thermocouple was charged with adipic acid, 1,6-hexanediol and 1,4-butanediol such that a molar ratio (OH/COOH) of a hydroxyl group to a carboxyl group was 1.2, that an acid component was composed of 100 mol % of adipic acid, and that an alcohol component was composed of 50 mol % of 1,6-hexanediol and 50 mol % of 1,4-butanediol. It was reacted at 180° C. for 10 hours along with titanium tetraisopropoxide (500 ppm by mass with respect to the resin component). It was then reacted for 3 hours at an elevated temperature of 200° C. and further reacted for 2 hours at a pressure of 8.3 kPa. Thereby, [Crystalline Resin 4] was obtained.

Obtained [Crystalline Resin 4] had a weight-average molecular weight of 14,000, a Mw/Mn of 3.5, a melting point of 49° C. and a glass transition temperature of 42° C.

A diffraction spectrum of obtained [Crystalline Resin 4] was measured by the x-ray diffraction method in the same manner as the crystalline resin of Synthesis Example 1, and an endothermic peak was observed from a diffraction peak in a range of 20°<2θ<25°. Thus, it was confirmed to have crystallinity.

(Synthesis Example of Crystalline Resin 5)

—Synthesis of Crystalline Resin 5—

A 5-L four-necked flask equipped with a nitrogen inlet tube, a dehydration tube, a stirrer and a thermocouple was charged with sebacic acid and 1,4-butanediol such that molar ratio (OH/COOH) of a hydroxyl group to a carboxyl group was 1.05. It was reacted at 180° C. for 10 hours along with titanium tetraisopropoxide (500 ppm by mass with respect to the resin component). It was reacted for 5 hours at an elevated temperature of 200° C. and further reacted for 4 hours at a pressure of 4.0 kPa. Thereby, [Crystalline Resin 5] was obtained.

Obtained [Crystalline Resin 5] had a weight-average molecular weight of 30,000, a Mw/Mn of 2.0, a melting point of 65° C. and a glass transition temperature of 57° C.

A diffraction spectrum of obtained [Crystalline Resin 5] was measured by the x-ray diffraction method in the same manner as the crystalline resin of Synthesis Example 1, and an endothermic peak was observed from a diffraction peak in a range of 20°<2θ<25°. Thus, it was confirmed to have crystallinity.

TABLE 1

| | Acid component | Alcohol component | | Molar ratio (OH/COOH) |
|---|---|---|---|---|
| Crystalline Resin 1 | sebacic acid | 1,4-butanediol | — | 1.2 |
| Crystalline Resin 2 | terephthalic acid | 1,4-butanediol | 1,5-pentanediol | 1.2 |
| Crystalline Resin 3 | terephthalic acid | 1,4-butanediol | 1,6-hexanediol | 1.2 |
| Crystalline Resin 4 | adipic acid | 1,4-butanediol | 1,6-hexanediol | 1.2 |
| Crystalline Resin 5 | sebacic acid | 1,4-butanediol | — | 1.05 |
| Crystalline Resin 6 | Polycaprolactone PLACCEL H, manufactured by Daicel Corporation | | | |

| | Weight-average molecular weight Mw | Mw/Mn | Melting point | Glass transition temperature |
|---|---|---|---|---|
| Crystalline Resin 1 | 15,000 | 3.0 | 62° C. | 55° C. |
| Crystalline Resin 2 | 12,000 | 4.0 | 69° C. | 58° C. |
| Crystalline Resin 3 | 13,000 | 4.2 | 84° C. | 52° C. |
| Crystalline Resin 4 | 14,000 | 3.5 | 49° C. | 42° C. |
| Crystalline Resin 5 | 30,000 | 2.0 | 65° C. | 57° C. |
| Crystalline Resin 6 | 10,000 | 3.0 | 60° C. | 52° C. |

(Synthesis Example of Non-Crystalline Resin 1)

—Synthesis of Non-Crystalline Resin 1—

A 5-L four-necked flask equipped with a nitrogen inlet tube, a dehydration tube, a stirrer and a thermocouple was charged with 100 parts by mass of L-lactide and D-lactide with a molar ratio (L-lactide D-lactide) of 75:25. Along with 1 part by mass of ethylene glycol and tin 2-ethylhexanoate (200 ppm by mass with respect to the resin component) as a catalyst, it was reacted at 190° C. for 4 hours. It was then reacted at a reduced temperature of 170° C. and a pressure of 8.3 kPa for 1 hour. Thereby, [Non-crystalline Resin 1] was obtained.

A diffraction spectrum of obtained [Non-crystalline Resin 1] was measured by the x-ray diffraction method in the same manner as the crystalline resin of Synthesis Example 1, and a broad peak spread widely across a measurement area was observed. Thus, it was confirmed to have non-crystallinity.

(Synthesis Example of Non-Crystalline Resin 2)

—Synthesis of Non-Crystalline Resin 2—

A reactor equipped with a cooling tube, a stirrer and a nitrogen inlet tube was charged with terephthalic acid and propylene glycol such that a molar ratio (OH/COOH) of a hydroxyl group to a carboxyl group was 1.3, along with titanium tetraisopropoxide (200 ppm by mass with respect to the resin component). Thereafter, it was heated over around 4 hours to 200° C. and then heated over 2 hours to 230° C., and a reaction was carried out until there was no effluent water. The reaction continued at a reduced pressure of 10 mm Hg to 15 mm Hg for 5 hours. Thereby, [Non-crystalline Resin 2] was obtained.

A diffraction spectrum of obtained [Non-crystalline Resin 2] was measured by the x-ray diffraction method in the same manner as the crystalline resin of Synthesis Example 1, and a broad peak spread widely across a measurement area was observed. Thus, it was confirmed to have non-crystallinity.

(Synthesis Example of Non-Crystalline Resin 3)

—Synthesis of Non-Crystalline Resin 3—

A 5-L four-necked flask equipped with a nitrogen inlet tube, a dehydration tube, a stirrer and a thermocouple was charged with 100 parts by mass of L-lactide and D-lactide with a molar ratio (L-lactide=D-lactide) of 90:10. Along with 5 parts by mass of propylene oxide 2-mole adduct of bisphenol A and tin 2-ethylhexanoate (200 ppm by mass with respect to the resin component) as a catalyst, it was reacted at 190° C. for 6 hours and then reacted for 2 hours at a reduced temperature of 180° C. and a pressure of 8.3 kPa. Thereby, [Non-crystalline Resin 3] was obtained.

A diffraction spectrum of obtained [Non-crystalline Resin 3] was measured by the x-ray diffraction method in the same manner as the crystalline resin of Synthesis Example 1, and a broad peak spread widely across a measurement area was observed. Thus, it was confirmed to have non-crystallinity.

(Synthesis Example of Non-Crystalline Resin 4)

—Synthesis of Non-Crystalline Resin 4—

A 5-L four-necked flask equipped with a nitrogen inlet tube, a dehydration tube, a stirrer and a thermocouple was charged with 100 parts by mass of L-lactide and D-lactide with a molar ratio (L-lactide:D-lactide) of 90:10. Along with 1 part by mass of ethylene glycol and tin 2-ethylhexanoate (200 ppm by mass with respect to the resin component) as a catalyst, it was reacted at 190° C. for 4 hours and then further reacted for 1 hour at a reduced temperature of 170° C. and a pressure of 8.3 kPa. Thereby, [Non-crystalline Resin 4] was obtained.

A diffraction spectrum of obtained [Non-crystalline Resin 4] was measured by the x-ray diffraction method in the same manner as the crystalline resin of Synthesis Example 1, and a broad peak spread widely across a measurement area was observed. Thus, it was confirmed to have non-crystallinity.

(Synthesis Example of Non-Crystalline Resin 5)

—Synthesis of Non-Crystalline Resin 5—

A 5-L four-necked flask equipped with a nitrogen inlet tube, a dehydration tube, a stirrer and a thermocouple was charged with 100 parts by mass of L-lactide and D-lactide with a molar ratio (L-lactide:D-lactide) of 70:30. Along with 5 parts by mass of hexanediol and tin 2-ethylhexanoate (200 ppm by mass with respect to the resin component) as a catalyst, it was reacted at 190° C. for 4 hours and then further reacted for 1 hour at a reduced temperature of 170° C. and a pressure of 8.3 kPa. Thereby, [Non-crystalline Resin 5] was obtained.

A diffraction spectrum of obtained [Non-crystalline Resin 5] was measured by the x-ray diffraction method in the same manner as the crystalline resin of Synthesis Example 1, and a broad peak spread widely across a measurement area was observed. Thus, it was confirmed to have non-crystallinity.

(Synthesis Example of Non-Crystalline Resin 6)

—Synthesis of Non-Crystalline Resin 6—

A 5-L four-necked flask equipped with a nitrogen inlet tube, a dehydration tube, a stirrer and a thermocouple was charged with 100 parts by mass of L-lactide and D-lactide with a molar ratio (L-lactide:D-lactide) of 93:7. Along with 0.5 parts by mass of ethylene glycol and tin 2-ethylhexanoate (200 ppm by mass with respect to the resin component) as a catalyst, it was reacted at 190° C. for 6 hours and then further reacted for 2 hours at a reduced temperature of 180° C. and at a pressure of 8.3 kPa. Thereby, [Non-crystalline Resin 6] was obtained.

A diffraction spectrum of obtained [Non-crystalline Resin 6] was measured by the x-ray diffraction method in the same manner as the crystalline resin of Synthesis Example 1, and a broad peak spread widely across a measurement area was observed. Thus, it was confirmed to have non-crystallinity.

(Synthesis Example of Non-Crystalline Resin 7)

—Synthesis of Non-Crystalline Resin 7—

A four-necked flask equipped with a nitrogen inlet tube, a dehydration tube, a stirrer and a thermocouple was charged with: ethylene oxide 2-mole adduct of bisphenol A; propylene oxide 2-mole adduct of bisphenol A; isophthalic acid; and adipic acid, with a molar ratio of the ethylene oxide 2-mole adduct of bisphenol A to the propylene oxide 2-mole adduct of bisphenol A (ethylene oxide 2-mole adduct of bisphenol A/propylene oxide 3-mole adduct of bisphenol A) of 80/20, with a molar ratio of the isophthalic acid to the adipic acid (isophthalic acid/adipic acid) of 80/20 and a molar ratio (OH/COOH) of a hydroxyl group to a carboxyl group of 1.3. Along with titanium tetraisopropoxide (300 ppm by mass with respect to the resin component), it was reacted at a normal pressure and at 230° C. for 8 hours and further reacted at a reduced pressure of 10 mm Hg to 15 mm Hg for 4 hours. Thereby, [Non-crystalline Resin 7] was obtained.

A diffraction spectrum of obtained [Non-crystalline Resin 7] was measured by the x-ray diffraction method in the same manner as the crystalline resin of Synthesis Example 1, and a broad peak spread widely across a measurement area was observed. Thus, it was confirmed to have non-crystallinity.

TABLE 2-1

| | Acid component | | Amount of acid component | Alcohol component | | Amount of alcohol component (OH/COOH) |
|---|---|---|---|---|---|---|
| Non-crystalline Resin 1 | L-lactide (75) | D-lactide (25) | 100 parts by mass | ethylene glycol | — | 1 parts by mass |
| Non-crystalline Resin 2 | terephthalic acid | — | — | propylene glycol | — | (1.3) |
| Non-crystalline Resin 3 | L-lactide (90) | D-lactide (10) | 100 parts by mass | propylene oxide 2-mole adduct of bisphenol A | — | 5 parts by mass |
| Non-crystalline Resin 4 | L-lactide (90) | D-lactide (10) | 100 parts by mass | ethylene glycol | — | 1 parts by mass |

TABLE 2-1-continued

| | | | | | | |
|---|---|---|---|---|---|---|
| Non-crystalline Resin 5 | L-lactide (70) | D-lactide (30) | 100 parts by mass | hexanediol | — | 5 parts by mass |
| Non-crystalline Resin 6 | L-lactide (93) | D-lactide (7) | 100 parts by mass | ethylene glycol | — | 0.5 parts by mass |
| Non-crystalline Resin 7 | isophthalic acid | adipic acid | — | PO 2-mole adduct of bisphenol A | EO 2-mole adduct of bisphenol A | (1.3) |

| | Weight-average molecular weight Mw | Mw/Mn | Glass transition temperature Tg |
|---|---|---|---|
| Non-crystalline Resin 1 | 20,000 | 3.2 | 48° C. |
| Non-crystalline Resin 2 | 7,000 | 3.5 | 62° C. |
| Non-crystalline Resin 3 | 13,000 | 3.3 | 51° C. |
| Non-crystalline Resin 4 | 22,000 | 2.8 | 53° C. |
| Non-crystalline Resin 5 | 10,000 | 3.5 | 42° C. |
| Non-crystalline Resin 6 | 45,000 | 3.1 | 55° C. |
| Non-crystalline Resin 7 | 8,000 | 3.2 | 58° C. |

(Synthesis Example of Resin E 1)

—Synthesis of Resin E 1—

A 5-L four-necked flask equipped with a nitrogen inlet tube, a dehydration tube, a stirrer and a thermocouple was charged with: 300 parts by mass of [Crystalline Resin 1]; 700 parts by mass of [Non-crystalline Resin 1]; and 200 ppm by mass of titanium tetraisopropoxide as a catalyst. It was reacted at 180° C. for 4 hours, and then it was reacted at a pressure of 8.3 kPa for 1 hour with its temperature reduced to 170° C. Thereby, [Resin E 1] having a crystalline portion C and a non-crystalline portion D in a molecule thereof was obtained.

(Synthesis Example of Resin E 2)

—Synthesis of Resin E 2—

A 5-L four-necked flask equipped with a nitrogen inlet tube, a dehydration tube, a stirrer and a thermocouple was charged with 300 parts by mass of [Crystalline Resin 1]; 700 parts by mass of [Non-crystalline Resin 2]; and 200 ppm by mass of titanium tetraisopropoxide as a catalyst. It was reacted at 180° C. for 4 hours, and then it was reacted at a pressure of 8.3 kPa for 1 hour with its temperature reduced to 170° C. Thereby, [Resin E 2] having a crystalline portion C and a non-crystalline portion D in a molecule thereof was obtained.

(Synthesis Example of Resin E 3)

—Synthesis of Resin E 3—

A 5-L four-necked flask equipped with a nitrogen inlet tube, a dehydration tube, a stirrer and a thermocouple was charged with: 300 parts by mass of [Crystalline Resin 2]; 700 parts by mass of [Non-crystalline Resin 1]; and 200 ppm by mass of titanium tetraisopropoxide as a catalyst. It was reacted at 180° C. for 4 hours, and then it was reacted at a pressure of 8.3 kPa for 1 hour with its temperature reduced to 170° C. Thereby, [Resin E 3] having a crystalline portion C and a non-crystalline portion D in a molecule thereof was obtained.

(Synthesis Example of Resin E 4)

—Synthesis of Resin E 4—

A 5-L four-necked flask equipped with a nitrogen inlet tube, a dehydration tube, a stirrer and a thermocouple was charged with: 300 parts by mass of [Crystalline Resin 1]; 700 parts by mass of [Non-crystalline Resin 3]; and 200 ppm by mass of titanium tetraisopropoxide as a catalyst. It was reacted at 180° C. for 4 hours, and then it was reacted at a pressure of 8.3 kPa for 1 hour with its temperature reduced to 170° C. Thereby, [Resin E 4] having a crystalline portion C and a non-crystalline portion D in a molecule thereof was obtained.

(Synthesis Example of Resin E 5)

—Synthesis of Resin E 5—

A 5-L four-necked flask equipped with a nitrogen inlet tube, a dehydration tube, a stirrer and a thermocouple was charged with: 300 parts by mass of [Crystalline Resin 1]; 700 parts by mass of [Non-crystalline Resin 4]; and 200 ppm by mass of titanium tetraisopropoxide as a catalyst. It was reacted at 180° C. for 4 hours, and then it was reacted at a pressure of 8.3 kPa for 1 hour with its temperature reduced to 170° C. Thereby, [Resin E 5] having a crystalline portion C and a non-crystalline portion D in a molecule thereof was obtained.

(Synthesis Example of Resin E 6)

—Synthesis of Resin E 6—

A 5-L four-necked flask equipped with a nitrogen inlet tube, a dehydration tube, a stirrer and a thermocouple was charged with: 300 parts by mass of [Crystalline Resin 1]; 700 parts by mass of [Non-crystalline Resin 5]; and 200 ppm by mass of titanium tetraisopropoxide as a catalyst. It was reacted at 180° C. for 4 hours, and then it was reacted at a pressure of 8.3 kPa for 1 hour with its temperature reduced to 170° C. Thereby, [Resin E 6] having a crystalline portion C and a non-crystalline portion D in a molecule thereof was obtained.

(Synthesis Example of Resin E 7)

—Synthesis of Resin E 7—

A 5-L four-necked flask equipped with a nitrogen inlet tube, a dehydration tube, a stirrer and a thermocouple was charged with: 300 parts by mass of [Crystalline Resin 1]; 700 parts by mass of [Non-crystalline Resin 6]; and 200 ppm by mass of titanium tetraisopropoxide as a catalyst. It was reacted at 180° C. for 4 hours, and then it was reacted at a pressure of 8.3 kPa for 1 hour with its temperature reduced to 170° C. Thereby, [Resin E 7] having a crystalline portion C and a non-crystalline portion D in a molecule thereof was obtained.

(Synthesis Example of Resin E 8)

—Synthesis of Resin E 8—

A 5-L four-necked flask equipped with a nitrogen inlet tube, a dehydration tube, a stirrer and a thermocouple was charged with: 300 parts by mass of [Crystalline Resin 3], 700 parts by mass of [Non-crystalline Resin 1], and 200 ppm by mass of titanium tetraisopropoxide as a catalyst. It was reacted at 180° C. for 4 hours, and then it was reacted at a pressure of 8.3 kPa for 1 hour with its temperature reduced to 170° C. Thereby, [Resin E 8] having a crystalline portion C and a non-crystalline portion D in a molecule thereof was obtained.

(Synthesis Example of Resin E 9)

—Synthesis of Resin E 9—

A 5-L four-necked flask equipped with a nitrogen inlet tube, a dehydration tube, a stirrer and a thermocouple was charged with: 300 parts by mass of [Crystalline Resin 4]; 700 parts by mass of [Non-crystalline Resin 1]; and 200 ppm by mass of titanium tetraisopropoxide as a catalyst. It was reacted at 180° C. for 4 hours, and then it was reacted at a pressure of 8.3 kPa for 1 hour with its temperature reduced to 170° C. Thereby, [Resin E 9] having a crystalline portion C and a non-crystalline portion D in a molecule thereof was obtained.

(Synthesis Example of Resin E 10)

—Synthesis of Resin E 10—

A 5-L four-necked flask equipped with a nitrogen inlet tube, a dehydration tube, a stirrer and a thermocouple was charged with: 700 parts by mass of [Crystalline Resin 1]; 300 parts by mass of [Non-crystalline Resin 1]; and 200 ppm by mass of titanium tetraisopropoxide as a catalyst. It was reacted at 180° C. for 4 hours, and then it was reacted at a pressure of 8.3 kPa for 1 hour with its temperature reduced to 170° C. Thereby, [Resin E 10] having a crystalline portion C and a non-crystalline portion D in a molecule thereof was obtained.

(Synthesis Example of Resin E 11)

—Synthesis of Resin E 11—

A 5-L four-necked flask equipped with a nitrogen inlet tube, a dehydration tube, a stirrer and a thermocouple was charged with: 180 parts by mass of [Crystalline Resin 1]; 820 parts by mass of [Non-crystalline Resin 1]; and 200 ppm by mass of titanium tetraisopropoxide as a catalyst. It was reacted at 180° C. for 4 hours, and then it was reacted at a pressure of 8.3 kPa for 1 hour with its temperature reduced to 170° C. Thereby, [Resin E 11] having a crystalline portion C and a non-crystalline portion D in a molecule thereof was obtained.

(Synthesis Example of Resin E 12)

—Synthesis of Resin E 12—

A 5-L four-necked flask equipped with a nitrogen inlet tube, a dehydration tube, a stirrer and a thermocouple was charged with: 820 parts by mass of [Crystalline Resin 1]; 180 parts by mass of [Non-crystalline Resin 1]; and 200 ppm by mass of titanium tetraisopropoxide as a catalyst. It was reacted at 180° C. for 4 hours, and then it was reacted at a pressure of 8.3 kPa for 1 hour with its temperature reduced to 170° C. Thereby, [Resin E 12] having a crystalline portion C and a non-crystalline portion D in a molecule thereof was obtained.

TABLE 3

| | Crystalline portion C | Mixing amount | Non-crystalline portion D | Mixing amount | Mass ratio C/D |
|---|---|---|---|---|---|
| Resin E 1 | Crystalline Resin 1 | 300 parts by mass | Non-crystalline Resin 1 | 700 parts by mass | 30/70 |
| Resin E 2 | Crystalline Resin 1 | 300 parts by mass | Non-crystalline Resin 2 | 700 parts by mass | 30/70 |
| Resin E 3 | Crystalline Resin 2 | 300 parts by mass | Non-crystalline Resin 1 | 700 parts by mass | 30/70 |
| Resin E 4 | Crystalline Resin 1 | 300 parts by mass | Non-crystalline Resin 3 | 700 parts by mass | 30/70 |
| Resin E 5 | Crystalline Resin 1 | 300 parts by mass | Non-crystalline Resin 4 | 700 parts by mass | 30/70 |
| Resin E 6 | Crystalline Resin 1 | 300 parts by mass | Non-crystalline Resin 5 | 700 parts by mass | 30/70 |
| Resin E 7 | Crystalline Resin 1 | 300 parts by mass | Non-crystalline Resin 6 | 700 parts by mass | 30/70 |
| Resin E 8 | Crystalline Resin 3 | 300 parts by mass | Non-crystalline Resin 1 | 700 parts by mass | 30/70 |
| Resin E 9 | Crystalline Resin 4 | 300 parts by mass | Non-crystalline Resin 1 | 700 parts by mass | 30/70 |
| Resin E 10 | Crystalline Resin 1 | 700 parts by mass | Non-crystalline Resin 1 | 300 parts by mass | 70/30 |
| Resin E 11 | Crystalline Resin 1 | 180 parts by mass | Non-crystalline Resin 1 | 820 parts by mass | 18/82 |
| Resin E 12 | Crystalline Resin 1 | 820 parts by mass | Non-crystalline Resin 1 | 180 parts by mass | 82/18 |

| | Weight-average molecular weight Mw | Mw/Mn | Glass transition temperature Tg |
|---|---|---|---|
| Resin E 1 | 25,000 | 2.3 | 42° C. |
| Resin E 2 | 15,000 | 2.8 | 44° C. |
| Resin E 3 | 26,000 | 2.5 | 42° C. |
| Resin E 4 | 23,000 | 2.9 | 46° C. |
| Resin E 5 | 28,000 | 2.7 | 48° C. |
| Resin E 6 | 16,000 | 3.1 | 35° C. |
| Resin E 7 | 48,000 | 2.8 | 53° C. |
| Resin E 8 | 26,000 | 3.1 | 44° C. |
| Resin E 9 | 25,000 | 2.8 | 40° C. |
| Resin E 10 | 18,000 | 2.5 | 46° C. |
| Resin E 11 | 26,000 | 2.4 | 41° C. |
| Resin E 12 | 17,000 | 2.6 | 48° C. |

Example 1

Preparation of Toner

—Preparation of Masterbatch (MB)—

First, 1,200 parts by mass of water, 500 parts by mass of carbon black (PRINTEX 35, manufactured by Evonik Degussa Japan Co., Ltd., DBP oil absorption=42 mL/100 mg, pH=9.5) and 500 parts by mass of [Non-crystalline Resin 1] were added and mixed by HENSCHEL MIXER (manufactured by Nippon Coke & Engineering. Co., Ltd.). Then, an obtained mixture was kneaded using two rolls at 150° C. for 30 minutes, rolled for cooling and pulverized by a pulverizer. Thereby, [Masterbatch 1] was obtained.

—Preparation of Wax Dispersion Liquid—

A container equipped with a stirring rod and a thermometer was charged with: 50 parts by mass of paraffin wax (hydrocarbon wax, HNP-9, manufactured by Nippon Seiro Co., Ltd., melting point=75° C., SP value=8.8) as [Releasing Agent]; and 450 parts by mass of ethyl acetate. It was heated to 80° C. with stirring, maintained at 80° C. for 5 hours and then cooled to 30° C. over 1 hour. Using a bead mill (ULTRA VISCO MILL, manufactured by Aimex Co., Ltd.) packed by 80% by volume with 0.5-mm zirconia beads, it was dispersed by running 3 passes under the conditions of a liquid feed rate of 1 kg/hr and a peripheral speed of a disc of 6 m/min. Thereby, [Wax Dispersion Liquid 1] was obtained.

—Preparation of Crystalline Resin Dispersion Liquid—

A container equipped with a stirring rod and a thermometer was charged with 50 parts by mass of [Crystalline Resin 1] and 450 parts by mass of ethyl acetate. It was heated to 80° C. with stirring, maintained at 80° C. for 5 hours and then cooled to 30° C. over 1 hour. Using a bead mill (ULTRA VISCO MILL, manufactured by Aimex Co., Ltd.) packed by 80% by volume with 0.5-mm zirconia beads, it was dispersed by running 3 passes under the conditions of a liquid feed rate of 1 kg/hr and a peripheral speed of a disc of 6 msec. Thereby, [Crystalline Resin Dispersion Liquid 1] (solid content concentration of 10% by mass) was obtained.

—Preparation of Oil Phase—

A container was charged with: 500 parts by mass of [Wax Dispersion Liquid 1]; 1,000 parts by mass of [Crystalline Resin Dispersion Liquid 1]; 450 parts by mass of [Non-crystalline Resin 1]; 300 parts by mass of [Resin E 1]; and 100 parts by mass of [Masterbatch 1]. It was mixed using a TK HOMOMIXER (manufactured by Primix Corporation) at 10,000 rpm for 60 minutes. Thereby, [Oil Phase 1] was obtained.

—Preparation of Aqueous Phase—

A milky liquid was obtained by mixing and stirring; 990 parts by mass of water; 10 parts by mass of a 50-% by mass aqueous solution of sodium dodecyl sulfate (manufactured by Tokyo Chemical Industry Co., Ltd.); 5 parts by mass of sodium chloride (manufactured by Tokyo Chemical Industry Co., Ltd.); and 100 parts by mass of ethyl acetate. This was regarded as [Aqueous Phase 1].

—Emulsification and Desolvation—

To the container containing [Oil Phase 1], 1,200 parts by mass of [Aqueous Phase 1] was added. It was then mixed using a TK HOMOMIXER (manufactured by Primix Corporation) at a rotational speed of 13,000 rpm for 20 minutes. Thereby, [Emulsified Slurry 1] was obtained.

[Emulsified Slurry 1] was placed in a container equipped with a stirrer and a thermometer for desolvation at 30° C. for 8 hours, followed by aging at 45° C. for 4 hours. Thereby, [Dispersion Slurry 1] was obtained.

—Washing and Drying—

After 100 parts by mass of [Dispersion Slurry 1] was subjected to vacuum filtration, a filter cake was washed and dried as follows.

(1) To the filter cake, 100 parts by mass of ion-exchanged water was added, which was mixed by TK HOMOMIXER (rotational speed of 12,000 rpm for 10 minutes) followed by filtration.

(2) To the filter cake of (1), 100 parts by mass of a 10-% by mass sodium hydroxide aqueous solution, which was mixed by TK HOMOMIXER (rotational speed of 12,000 rpm for 30 minutes) followed by vacuum filtration.

(3) To the filter cake of (2), 100 parts by mass of 10-% by mass hydrochloric acid was added, which was mixed by TK HOMOMIXER (rotational speed of 12,000 rpm for 10 minutes) followed by filtration.

(4) To the filter cake of (3), 300 parts by mass of ion-exchanged water was added, which was mixed by TK HOMOMIXER (rotational speed of 12,000 rpm for 10 minutes) followed by filtration.

The operations of (1) to (4) were repeated twice, and thereby, [Filter Cake 1] was obtained.

Obtained [Filter Cake 1] was dried in a wind dryer at 45° C. for 48 hours and sieved with a mesh having openings of 75 μm. Thereby, [Toner 1] of Example 1 was obtained.

Example 2

Preparation of Toner

[Toner 2] of Example 2 was obtained in the same manner as Example 1 except that [Non-crystalline Resin 1] and [Resin E 1] in Example 1 were changed to [Non-crystalline Resin 2] and [Resin E 2], respectively.

Example 3

Preparation of Toner

[Toner 3] of Example 3 was obtained in the same manner as Example 1 except that [Crystalline Resin 1] and [Resin E 1] in Example 1 were changed to [Crystalline Resin 2] and [Resin E 3], respectively.

Example 4

Preparation of Toner

[Toner 4] of Example 4 was obtained in the same manner as Example 1 except that [Non-crystalline Resin 1] and [Resin E 1] in Example 1 were changed to [Non-crystalline Resin 3] and [Resin E 4], respectively.

Example 5

Preparation of Toner

[Toner 5] of Example 5 was obtained in the same manner as Example 1 except that the mixing amount of the materials in "Preparation of oil phase" in Example 1 was changed as follows.

—Preparation of Oil Phase—

A container was charged with: 500 parts by mass of [Wax Dispersion Liquid 1]; 3,000 parts by mass of [Crystalline Resin Dispersion Liquid 1]; 450 parts by mass of [Non-crystalline Resin 1]; 100 parts by mass of [Resin E 1]; and 100 parts by mass of [Masterbatch 1]. It was mixed using a TK HOMOMIXER (manufactured by Primix Corporation) at 10,000 rpm for 60 minutes. Thereby, [Oil Phase 5] was obtained.

Example 6

Preparation of Toner

[Toner 6] of Example 6 was obtained in the same manner as Example 1 except that the mixing amount of the materials in "Preparation of oil phase" in Example 1 was changed as follows.

—Preparation of Oil Phase—

A container was charged with: 500 parts by mass of [Wax Dispersion Liquid 1]; 500 parts by mass of [Crystalline Resin Dispersion Liquid 1]; 600 parts by mass of [Non-crystalline Resin 1]; 100 parts by mass of [Resin E 1]; and 100 parts by mass of [Masterbatch 1]. It was mixed using a TK HOMOMIXER (manufactured by Primix Corporation) at 10,000 rpm for 60 minutes. Thereby, [Oil Phase 6] was obtained.

Example 7

Preparation of Toner

[Toner 7] of Example 7 was obtained in the same manner as Example 1 except that [Non-crystalline Resin 1] and [Resin E 1] in Example 1 were replaced by [Non-crystalline Resin 4] and [Resin E 5], respectively.

Example 8

Preparation of Toner

[Toner 8] of Example 8 was obtained in the same manner as Example 1 except that [Crystalline Resin Dispersion Liquid 5] (solid content concentration of 10% by mass) was prepared with [Crystalline Resin 1] in Example 1 replaced by [Crystalline Resin 5] and that the mixing amount of the materials in "Preparation of oil phase" in Example 1 was changed as follows.

—Preparation of Oil Phase—

A container was charged with: 500 parts by mass of [Wax Dispersion Liquid 1]; 5,500 parts by mass of [Crystalline Resin Dispersion Liquid 5]; 200 parts by mass of [Non-crystalline Resin 1]; 100 parts by mass of [Resin E 1]; and 100 parts by mass of [Masterbatch 1]. It was mixed using a TK HOMOMIXER (manufactured by Primix Corporation) at 10,000 rpm for 60 minutes. Thereby, [Oil Phase 8] was obtained.

Example 9

Preparation of Toner

[Toner 9] of Example 9 was obtained in the same manner as Example 1 except that the mixing amount of the materials in "Preparation of oil phase" in Example 1 was changed as follows.

—Preparation of Oil Phase—

A container was charged with: 500 parts by mass of [Wax Dispersion Liquid 1]; 700 parts by mass of [Crystalline Resin Dispersion Liquid 1]; 450 parts by mass of [Non-crystalline Resin 1]; 330 parts by mass of [Resin E 1]; and 100 parts by mass of [Masterbatch 1]. It was mixed using a TK HOMOMIXER (manufactured by Primix Corporation) at 10,000 rpm for 60 minutes. Thereby, [Oil Phase 9] was obtained.

Example 10

Preparation of Toner

[Toner 10] of Example 10 was obtained in the same manner as Example 1 except that the mixing amount of the materials in "Preparation of oil phase" in Example 1 was changed as follows.

—Preparation of Oil Phase—

A container was charged with: 500 parts by mass of [Wax Dispersion Liquid 1]; 1,200 parts by mass of [Crystalline Resin Dispersion Liquid 1]; 450 parts by mass of [Non-crystalline Resin 1]; 280 parts by mass of [Resin E 1]; and 100 parts by mass of [Masterbatch 1]. It was mixed using a TK HOMOMIXER (manufactured by Primix Corporation) at 10,000 rpm for 60 minutes. Thereby, [Oil Phase 10] was obtained.

Example 11

Preparation of Toner

[Toner 11] of Example 11 was obtained in the same manner as Example 1 except that [Non-crystalline Resin 1] and [Resin E 1] in Example 1 were replaced by [Non-crystalline Resin 7] and [Resin E 2], respectively.

Example 12

Preparation of Toner

[Toner 12] of Example 12 was obtained in the same manner as Example 1 except that [Resin E 1] in Example 1 was replaced by [Resin E 10] and that the mixing amount of the materials in "Preparation of oil phase" in Example 1 was changed as follows.

—Preparation of Oil Phase—

A container was charged with: 500 parts by mass of [Wax Dispersion Liquid 1]; 1,000 parts by mass of [Crystalline Resin Dispersion Liquid 1]; 600 parts by mass of [Non-crystalline Resin 1]; 150 parts by mass of [Resin E 10] and 100 parts by mass of [Masterbatch 1]. It was mixed using a TK HOMOMIXER (manufactured by Primix Corporation) at 10,000 rpm for 60 minutes. Thereby, [Oil Phase 12] was obtained.

Example 13

Preparation of Toner

[Toner 13] of Example 13 was obtained in the same manner as Example 1 except that [Resin E 1] in Example 1 was replaced by [Resin E 11] and that the mixing amount of the materials in "Preparation of oil phase" in Example 1 was changed as follows.

—Preparation of Oil Phase—

A container was charged with: 500 parts by mass of [Wax Dispersion Liquid 1]; 800 parts by mass of [Crystalline Resin Dispersion Liquid 1]; 370 parts by mass of [Non-crystalline Resin 1]; 400 parts by mass of [Resin E 11] and 100 parts by mass of [Masterbatch 1]. It was mixed using a TK HOMOMIXER (manufactured by Primix Corporation) at 10,000 rpm for 60 minutes. Thereby, [Oil Phase 13] was obtained.

Example 14

Preparation of Toner

[Toner 14] of Example 14 was obtained in the same manner as Example 1 except that [Resin E 1] in Example 1 was replaced by [Resin E 12] and that the mixing amount of the materials in "Preparation of oil phase" in Example 1 was changed as follows.

—Preparation of Oil Phase—

A container was charged with: 500 parts by mass of [Wax Dispersion Liquid 1]; 1,000 parts by mass of [Crystalline Resin Dispersion Liquid 1]; 620 parts by mass of [Non-crystalline Resin 1]; 130 parts by mass of [Resin E 12] and 100 parts by mass of [Masterbatch 1]. It was mixed using a TK HOMOMIXER (manufactured by Primix Corporation) at 10,000 rpm for 60 minutes. Thereby, [Oil Phase 14] was obtained.

Example 15

Preparation of Toner

[Toner 15] of Example 15 was obtained in the same manner as Example 1 except that [Resin E 1] in Example 1 was replaced by [Resin E 2].

Example 16

Preparation of Toner

[Toner 16] of Example 16 was obtained in the same manner as Example 1 except that the mixing amount of the materials in "Preparation of oil phase" in Example 1 was changed as follows.

—Preparation of Oil Phase—

A container was charged with: 500 parts by mass of [Wax Dispersion Liquid 1]; 500 parts by mass of [Crystalline Resin Dispersion Liquid 1]; 400 parts by mass of [Non-crystalline Resin 1]; 400 parts by mass of [Resin E 1]; and 100 parts by mass of [Masterbatch 1]. It was mixed using a TK HOMOMIXER (manufactured by Primix Corporation) at 10,000 rpm for 60 minutes. Thereby, [Oil Phase 16] was obtained.

Example 17

Preparation of Toner

[Toner 17] of Example 17 was obtained in the same manner as Example 1 except that the mixing amount of the materials in "Preparation of oil phase" in Example 1 was changed as follows.

—Preparation of Oil Phase—

A container was charged with: 500 parts by mass of [Wax Dispersion Liquid 1]; 1500 parts by mass of [Crystalline Resin Dispersion Liquid 1]; 100 parts by mass of [Non-crystalline Resin 1]; 600 parts by mass of [Resin E 1]; and 100 parts by mass of [Masterbatch 1]. It was mixed using a TK HOMOMIXER (manufactured by Primix Corporation) at 10,000 rpm for 60 minutes. Thereby, [Oil Phase 17] was obtained.

Comparative Example 1

Preparation of Toner

[Toner 18] of Comparative Example 1 was obtained in the same manner as Example 1 except that the mixing amount of the materials in "Preparation of oil phase" in Example 1 was changed as follows.

—Preparation of Oil Phase—

A container was charged with; 500 parts by mass of [Wax Dispersion Liquid 1]; 2,000 parts by mass of [Crystalline Resin Dispersion Liquid 1]; 650 parts by mass of [Non-crystalline Resin 1] and 100 parts by mass of [Masterbatch 1]. It was mixed using a TK HOMOMIXER (manufactured by Primix Corporation) at 10,000 rpm for 60 minutes. Thereby, [Oil Phase 18] was obtained.

Comparative Example 2

Preparation of Toner

[Toner 19] of Comparative Example 2 was obtained in the same manner as Example 1 except that [Non-crystalline Resin 1] and [Resin E 1] in Example 1 were replaced by [Non-crystalline Resin 5] and [Resin E 6], respectively.

Comparative Example 3

Preparation of Toner

[Toner 20] of Comparative Example 3 was obtained in the same manner as Example 1 except that [Non-crystalline Resin 1] and [Resin E 1] in Example 1 were replaced by [Non-crystalline Resin 6] and [Resin E 7], respectively.

Comparative Example 4

Preparation of Toner

[Toner 21] of Comparative Example 4 was obtained in the same manner as Example 1 except that [Crystalline Resin 1] and [Resin E 1] in Example 1 were replaced by [Crystalline Resin 3] and [Resin E 8], respectively.

Comparative Example 5

Preparation of Toner

[Toner 22] of Comparative Example 5 was obtained in the same manner as Example 1 except that [Crystalline Resin 1] and [Resin E 1] in Example 1 were replaced by [Crystalline Resin 4] and [Resin E 9], respectively.

Comparative Example 6

Preparation of Toner

[Toner 23] of Comparative Example 6 was obtained in the same manner as Example 1 except that [Crystalline Resin 1] and [Non-crystalline Resin 1] in Example 1 were replaced by [Crystalline Resin 6] (polycaprolactone, PLACCEL H, manufactured by Daicel Corporation, highly crystalline aliphatic polyester resin) and [Non-crystalline Resin 7], respectively.

Comparative Example 7

Preparation of Toner

[Toner 24] of Comparative Example 7 was obtained in the same manner as Example 1 except that the mixing amount of the materials in "Preparation of oil phase" in Example 1 was changed as follows.

—Preparation of Oil Phase—

A container was charged with: 500 parts by mass of [Wax Dispersion Liquid 1]; 650 parts by mass of [Non-crystalline Resin 1], 200 parts by mass of [Resin E 1] and 100 parts by mass of [Masterbatch 1]. It was mixed using a TK HOMOMIXER (manufactured by Primix Corporation) at 10,000 rpm for 60 minutes. Thereby, [Oil Phase 19] was obtained.

Comparative Example 8

Preparation of Toner

[Toner 25] of Comparative Example 8 was obtained in the same manner as Example 1 except that the mixing amount of the materials in "Preparation of oil phase" in Example 1 was changed as follows.

—Preparation of Oil Phase—

A container was charged with: 500 parts by mass of [Wax Dispersion Liquid 1]; 3,000 parts by mass of [Crystalline Resin Dispersion Liquid 1]; 600 parts by mass of [Resin E 1]; and 50 parts by mass of carbon black (PRINTEX35, manufactured by Evonik Degussa Japan Co., Ltd., DBP oil absorption=42 mL/100 mg, pH=9.5). It was mixed using a TK HOMOMIXER (manufactured by Primix Corporation) at 10,000 rpm for 180 minutes. Thereby, [Oil Phase 20] was obtained.

Comparative Example 9

Preparation of Toner

[Toner 26] of Comparative Example 9 was obtained in the same manner as Example 1 except that the mixing amount of the materials in "Preparation of oil phase" in Example 1 was changed as follows.

—Preparation of Oil Phase—

A container was charged with: 500 parts by mass of [Wax Dispersion Liquid 1]; 900 parts by mass of [Resin E 1]; and 50 parts by mass of carbon black (PRINTEX35, manufactured by Evonik Degussa Japan Co., Ltd., DBP oil absorption=42 mL/100 mg, pH=9.5). It was mixed using a TK HOMOMIXER (manufactured by Primix Corporation) at 10,000 rpm for 180 minutes. Thereby, [Oil Phase 21] was obtained.

Next, for each of the obtained toners, a glass transition temperature Tg of the toner, an endothermic peak temperature mp of the toner, a ratio Q2/Q1 of an endothermic quantity Q1 in the first DSC heating to an endothermic quantity Q2 in the second DSC heating by melting of a crystalline portion (crystalline resin A and crystalline portion C of resin E) in the toner, a TMA amount of compressive deformation of the toner, and a relative crystallinity of the toner were measured as follows. Results are shown in Table 4.

<Measurements of Glass Transition Temperature Tg of Toner, Endothermic Peak Temperature mp of Toner and Endothermic Quantities (Q1, Q2)>

A measurement object was stored in an isothermal environment having a temperature of 45° C. and a humidity of 20% RH or less for 24 hours in order to have constant initial conditions of the crystalline portion and the non-crystalline portion of the toner. It was then stored at a temperature of 23° C. or less, and Tg, mp, Q1 and Q2 are measured within 24 hours. By this operation, an effect of thermal history in a high-temperature storage environment was reduced, and the condition of the crystalline portion and the non-crystalline portion of the toner was uniformized.

First, 5 mg of a particulate toner was sealed in a T-ZERO simple sealing pan, manufactured by TA Instruments, and a measurement was made using a differential scanning calorimeter (DSC) (manufactured by TA Instruments, Q2000). Regarding the measurement, under a stream of nitrogen, the toner was heated as a first heating from −20° C. to 200° C. at a heating rate of 10° C./min, maintained for 5 minutes, then cooled to −20° C. at a cooling rate of 10° C./min, maintained for 5 minutes, and then heated as a second heating to 200° C. at a heating rate of 10° C./min. Thermal changes were measured, and graphs of "endothermic-exothermic quantity" and "temperature" were created. A temperature at a characteristic inflection point observed at this time was defined as the glass transition temperature Tg.

As the glass transition temperature Tg, a value obtained by a mid-point method in the analysis programs of the apparatus using the graph of the first heating was used.

Also, the endothermic peak temperature (mp) was calculated as a maximum peak temperature using an analysis program of the apparatus using the graph of the first heating.

Also, the Q1 was calculated as an amount of heat of fusion of the crystalline component using an analysis program of the apparatus using the graph of the first heating.

Also, the Q2 was calculated as an amount of heat of fusion of the crystalline component using an analysis program of the apparatus using the second heating.

<TMA Amount of Compressive Deformation>

The TMA amount of compressive deformation was measured by using 0.5 g of the toner formed into a tablet by a tablet molding machine (manufactured by Shimadzu Corporation) having a diameter of 3 mm with a thermo-mechanical measuring apparatus (EXSTAR7000, manufactured by SII NanoTechnology Inc.). The tablet was heated at 2° C./min from 0° C. to 180° C. under a stream of nitrogen, and the measurement was carried out in a compressed mode. A compressive force at this time was 100 mN. The amount of compressive deformation at 50° C. was read from an obtained graph of a sample temperature and a compression displacement (deformation ratio), and this value was referred to as the TMA amount of compressive deformation.

<Measurement of Crystallinity of Toner by X-Ray Diffraction Method>

A crystallinity of the toner by an x-ray diffraction method was measured using a crystallinity analysis x-ray diffractometer (X'PERT MRD, manufactured by Philips).

First, the toner as a target sample was ground by a mortar to prepare a sample powder, and the obtained sample powder was uniformly applied to a sample holder. Thereafter, the sample holder was set in the crystallinity analysis x-ray diffractometer, and a measurement was made to obtain a diffraction spectrum.

Among obtained diffraction peaks, a peak in a range of $20° < 2\theta < 25°$ was regarded as an endothermic peak derived from the crystalline portion. Also, a broad peak spreading widely across the measurement area was regarded as a component derived from the non-crystalline portion. For each peak, an integrated area of the diffraction spectrum from which a background was subtracted was calculated. An area value derived from the crystalline portion was regarded as Sc, and an area value derived from the non-crystalline portion was regarded as Sa. From Sc/Sa, the relative crystallinity may be calculated.

Measurement conditions of the x-ray diffraction method were as follows.

[Measurement Conditions]

Tension kV: 45 kV
Current: 40 mA
MPSS
Upper
Gonio
Scanmode: continuos
Start angle: 3°
End angle: 35°
Angle Step: 0.02°
Lucident beam optics
Divergence slit: Div slit 1/2
Diflection beam optics
Anti scatter slit: As Fixed 1/2
Receiving slit: Prog rec slit (Preparation of Developer)

—Preparation of Carrier—

To 100 parts by mass of toluene, 100 parts by mass of a silicone resin (organo straight silicone, manufactured by Shin-Etsu Chemical Co., Ltd.), 5 parts by mass of γ-(2-aminoethyl)aminopropyltrimethoxysilane and 10 parts by mass of carbon black were added. It was dispersed by a homomixer for 20 minutes, and thereby, a resin layer coating solution was prepared.

Next, [Carrier] was prepared by applying a resin layer coating solution on a surface of 1,000 parts by mass of spherical magnetite having a volume-average particle diameter of 50 μm using a fluidized bed type coating apparatus.

—Preparation of Developer—

[Developers] were prepared by 5 parts by mass of [Toners] were respectively mixed with 95 parts by mass of [Carrier] using a ball mill.

Next, using [Toners] and [Developers] thus prepared, various properties were evaluated as follows. Results are shown in Table 4.

<Low-Temperature Fixing Property and High Temperature-Resistant Offset Property>

Using a remodeled image forming apparatus that a fixing unit of a copying machine (MF2200, manufactured by Ricoh Company, Ltd.) using a TEFLON (registered trademark) roller as a fixing roller was remodeled so that a temperature of the fixing roller could be varied, a copying test was carried out on TYPE 6200 paper (manufactured by Ricoh Company, Ltd.).

By varying the temperature of the fixing roller, a low-temperature offset temperature (minimum fixing temperature) and a high-temperature offset temperature (maximum fixing temperature) were obtained under the following evaluation conditions, and based on the following criteria, a low-temperature fixing property and a high temperature-resistant offset property were evaluated. Specifically, a low-temperature offset and a high-temperature offset were visually determined by confirming whether or not there was an offset of an image at a location one rotation ahead of the fixing roller from a fixed image portion on paper. It was regarded as no-good (NG) when the offset of an image was confirmed. A lowest temperature at which no low-temperature offset occurred was defined as the minimum fixing temperature, and a highest temperature at which no high-temperature offset occurred was defined as the maximum fixing temperature.

As evaluation conditions of the minimum fixing temperature, a linear velocity of paper feed was 120 mm/sec to 150 mm/sec, a surface pressure was 1.2 kgf/cm$^2$, and a nip width was 3 mm.

As evaluation conditions of the maximum fixing temperature, the linear velocity of paper feed was 50 mm/sec, the surface pressure was 2.0 kgf/cm$^2$, and the nip width was 4.5 mm.

[Evaluation Criteria of Low-Temperature Fixing Property]

A: The minimum fixing temperature was 105° C. or less.

B: The minimum fixing temperature exceeded 105° C. and was less than 115° C.

F: The minimum fixing temperature exceeded 115° C.

[Evaluation Criteria of High Temperature-Resistant Offset Property]

A: The maximum fixing temperature was 165° C. or greater

B: The maximum fixing temperature was 150° C. or greater and less than 165° C.

F: The maximum fixing temperature was less than 150° C.

<Heat-Resistant Storage Stability>

A 50-mL glass container was filled with each toner, and it was placed in a thermostatic bath at 50° C. and left for 20 hours. Thereafter, the toner was cooled to a room temperature (25° C.). A penetration (mm) was measured according to a penetration test (JIS K2235-1991), and heat-resistant storage stability was evaluated based on the following criteria. Here, a larger value of the penetration indicates superior heat-resistant storage stability of the toner.

[Evaluation Criteria]

AA: The penetration was 20 mm or greater.

A: The penetration was 15 mm or greater and less than 20 mm.

B: The penetration was 10 mm or greater and less than 15 mm.

F: The penetration was less than 10 mm.

<Filming>

Using an image forming apparatus (MF2800, manufactured by Ricoh Company, Ltd.), a test chart including solid portions, half-tone portions, thick lines and thin likes was printed. After printing on 10,000 sheets and 100,000 sheets, a surface of the photoconductor was visually observed, and whether or not the toner (mainly the releasing agent) was adhered to the photoconductor was evaluated based on the following criteria. Also, after printing on 10,000 sheets and 100,000 sheets, whether or not abnormal images such as uneven image and crumbling image at the solid portions and the half-tone portions of images, and whether or not abnormal images such as void in the thick lines and the thin lines were evaluated based on the following criteria.

[Evaluation Criteria]

AA: The toner adhesion to the photoconductor was not confirmed after printing 100,000 sheets.

A: The toner adhesion to the photoconductor was not confirmed after printing 10,000 sheets. The toner adhesion was confirmed after printing 100,000 sheets, but it was not a level that the abnormality was observed in the images.

B: The toner adhesion to the photoconductor was confirmed after printing 10,000 sheets, but it was not a level that the abnormality was observed in the images. The toner adhesion to the photoconductor was confirmed after printing 100,000 sheets, and it was a level that the abnormality was observed in the images.

F: The toner adhesion to the photoconductor was confirmed after printing 10,000 sheets, and it was a level that the abnormality was observed in the images.

TABLE 4

| | | Example 1 | Example 2 | Example 3 | Example 4 | Example 5 |
|---|---|---|---|---|---|---|
| Crystalline resin A No. | | 1 | 1 | 2 | 1 | 1 |
| Non-crystalline resin B No. | | 1 | 2 | 1 | 3 | 1 |
| Resin E | Resin E No. | E1 | E2 | E3 | E4 | E1 |
| | Crystalline portion C No. | 1 | 1 | 2 | 1 | 1 |
| | Non-crystalline portion D No. | 1 | 2 | 1 | 3 | 1 |
| | Mass ratio (C/D) | 0.43 | 0.43 | 0.43 | 0.43 | 0.43 |
| Content of crystalline resin A (% by mass) | | 10 | 10 | 10 | 10 | 30 |

TABLE 4-continued

| | | | | | | |
|---|---|---|---|---|---|---|
| Content of non-crystalline resin B (% by mass) | | 50 | 50 | 50 | 50 | 50 |
| Content of resin E (% by mass) | | 30 | 30 | 30 | 30 | 10 |
| Content of crystalline portion C (% by mass) | | 9.0 | 9.0 | 9.0 | 9.0 | 3.0 |
| Content of non-crystalline portion D (% by mass) | | 21.0 | 21.0 | 21.0 | 21.0 | 7.0 |
| Mass ratio (A/C) | | 1.1 | 1.1 | 1.1 | 1.1 | 10.0 |
| Mass ratio (B/D) | | 2.4 | 2.4 | 2.4 | 2.4 | 7.1 |
| Glass transition temperature Tg (° C.) of toner | | 35 | 33 | 38 | 37 | 34 |
| Endothermic peak temperature mp (° C.) of toner | | 60 | 57 | 68 | 59 | 60 |
| Endothermic quantity Q1 of crystalline portion (crystalline resin A and crystalline portion C) in toner (J/g) | | 30 | 15 | 15 | 25 | 50 |
| Endothermic quantity Q2 of crystalline portion (crystalline resin A and crystalline portion C) in toner (J/g) | | 3 | 2 | 4 | 8 | 10 |
| Ratio Q2/Q1 | | 0.10 | 0.13 | 0.27 | 0.32 | 0.20 |
| TMA amount of compressive deformation of toner (%) | | 2 | 3 | 4 | 3 | 3 |
| Relative crystallinity of toner (%) | | 38 | 28 | 16 | 27 | 52 |
| Low-temperature fixing property | Minimum fixing temperature (° C.) | 100 | 105 | 110 | 110 | 105 |
| | Evaluation | A | A | B | B | A |
| High temperature-resistant offset property | Maximum fixing temperature (° C.) | 180 | 170 | 180 | 170 | 160 |
| | Evaluation | A | A | A | A | B |
| Heat-resistant storage stability | | AA | A | A | AA | AA |
| Filming | | AA | A | AA | A | A |

| | | Example 6 | Example 7 | Example 8 | Example 9 | Example 10 |
|---|---|---|---|---|---|---|
| Crystalline resin A No. | | 1 | 1 | 5 | 1 | 1 |
| Non-crystalline resin B No. | | 1 | 4 | 1 | 1 | 1 |
| Resin E | Resin E No. | E1 | E5 | E1 | E1 | E1 |
| | Crystalline portion C No. | 1 | 1 | 1 | 1 | 1 |
| | Non-crystalline portion D No. | 1 | 4 | 1 | 1 | 1 |
| | Mass ratio (C/D) | 0.43 | 0.43 | 0.43 | 0.43 | 0.43 |
| Content of crystalline resin A (% by mass) | | 5 | 10 | 55 | 7 | 12 |
| Content of non-crystalline resin B (% by mass) | | 65 | 50 | 25 | 50 | 50 |
| Content of resin E (% by mass) | | 10 | 30 | 10 | 33 | 28 |
| Content of crystalline portion C (% by mass) | | 3.0 | 9.0 | 3.0 | 9.9 | 8.4 |
| Content of non-crystalline portion D (% by mass) | | 7.0 | 21.0 | 7.0 | 23.1 | 19.6 |
| Mass ratio (A/C) | | 1.7 | 1.1 | 18.3 | 0.7 | 1.4 |
| Mass ratio (B/D) | | 0.9 | 2.4 | 3.6 | 2.2 | 2.6 |
| Glass transition temperature Tg (° C.) of toner | | 36 | 42 | 28 | 34 | 36 |
| Endothermic peak temperature mp (° C.) of toner | | 58 | 58 | 62 | 60 | 60 |
| Endothermic quantity Q1 of crystalline portion (crystalline resin A and crystalline portion C) in toner (J/g) | | 10 | 27 | 80 | 20 | 35 |
| Endothermic quantity Q2 of crystalline portion (crystalline resin A and crystalline portion C) in toner (J/g) | | 2 | 3 | 50 | 2 | 5 |
| Ratio Q2/Q1 | | 0.20 | 0.11 | 0.63 | 0.10 | 0.14 |
| TMA amount of compressive deformation of toner (%) | | 3 | 2 | 3 | 4 | 2 |
| Relative crystallinity of toner (%) | | 8 | 29 | 65 | 28 | 42 |
| Low-temperature fixing property | Minimum fixing temperature (° C.) | 110 | 110 | 105 | 105 | 105 |
| | Evaluation | B | B | A | A | A |
| High temperature-resistant offset property | Maximum fixing temperature (° C.) | 180 | 180 | 170 | 180 | 170 |
| | Evaluation | A | A | A | A | A |
| Heat-resistant storage stability | | A | AA | A | A | AA |
| Filming | | AA | AA | A | AA | A |

TABLE 4-continued

| | | Example 11 | Example 12 | Example 13 | Example 14 |
|---|---|---|---|---|---|
| Crystalline resin A No. | | 1 | 1 | 1 | 1 |
| Non-crystalline resin B No. | | 7 | 1 | 1 | 1 |
| Resin E | Resin E No. | E2 | E10 | E11 | E12 |
| | Crystalline portion C No. | 1 | 1 | 1 | 1 |
| | Non-crystalline portion D No. | 2 | 1 | 1 | 1 |
| | Mass ratio (C/D) | 0.43 | 2.3 | 0.22 | 4.6 |
| Content of crystalline resin A (% by mass) | | 10 | 10 | 8 | 10 |
| Content of non-crystalline resin B (% by mass) | | 50 | 65 | 42 | 67 |
| Content of resin E (% by mass) | | 30 | 15 | 40 | 13 |
| Content of crystalline portion C (% by mass) | | 9.0 | 10.5 | 7.2 | 10.7 |
| Content of non-crystalline portion D (% by mass) | | 21.0 | 4.5 | 32.8 | 2.3 |
| Mass ratio (A/C) | | 1.1 | 1.0 | 1.1 | 0.9 |
| Mass ratio (B/D) | | 2.4 | 14.4 | 1.3 | 28.6 |
| Glass transition temperature Tg (° C.) of toner | | 35 | 35 | 33 | 35 |
| Endothermic peak temperature mp (° C.) of toner | | 60 | 60 | 60 | 60 |
| Endothermic quantity Q1 of crystalline portion (crystalline resin A and crystalline portion C) in toner (J/g) | | 30 | 35 | 25 | 40 |
| Endothermic quantity Q2 of crystalline portion (crystalline resin A and crystalline portion C) in toner (J/g) | | 3 | 3 | 2 | 3 |
| Ratio Q2/Q1 | | 0.10 | 0.09 | 0.08 | 0.08 |
| TMA amount of compressive deformation of toner (%) | | 3 | 2 | 3 | 2 |
| Relative crystallinity of toner (%) | | 35 | 40 | 25 | 44 |
| Low-temperature fixing property | Minimum fixing temperature (° C.) | 105 | 100 | 105 | 105 |
| | Evaluation | A | A | A | A |
| High temperature-resistant offset property | Maximum fixing temperature (° C.) | 175 | 180 | 180 | 170 |
| | Evaluation | A | A | A | A |
| Heat-resistant storage stability | | A | AA | A | AA |
| Filming | | A | AA | AA | A |

| | | Example 15 | Example 16 | Example 17 |
|---|---|---|---|---|
| Crystalline resin A No. | | 1 | 1 | 1 |
| Non-crystalline resin B No. | | 1 | 1 | 1 |
| Resin E | Resin E No. | E2 | E1 | E1 |
| | Crystalline portion C No. | 1 | 1 | 1 |
| | Non-crystalline portion D No. | 2 | 1 | 1 |
| | Mass ratio (C/D) | 0.43 | 0.43 | 0.43 |
| Content of crystalline resin A (% by mass) | | 10 | 5 | 15 |
| Content of non-crystalline resin B (% by mass) | | 50 | 45 | 15 |
| Content of resin E (% by mass) | | 30 | 40 | 60 |
| Content of crystalline portion C (% by mass) | | 9.0 | 12.0 | 18.0 |
| Content of non-crystalline portion D (% by mass) | | 21.0 | 28.0 | 42.0 |
| Mass ratio (A/C) | | 0.9 | 0.4 | 0.8 |
| Mass ratio (B/D) | | 2.4 | 0.7 | 0.4 |
| Glass transition temperature Tg (° C.) of toner | | 38 | 34 | 36 |
| Endothermic peak temperature mp (° C.) of toner | | 61 | 59 | 61 |
| Endothermic quantity Q1 of crystalline portion (crystalline resin A and crystalline portion C) in toner (J/g) | | 27 | 25 | 45 |
| Endothermic quantity Q2 of crystalline portion (crystalline resin A and crystalline portion C) in toner (J/g) | | 3 | 2 | 5 |
| Ratio Q2/Q1 | | 0.11 | 0.08 | 0.11 |

TABLE 4-continued

| | | | | |
|---|---|---|---|---|
| TMA amount of compressive deformation of toner (%) | | 4 | 4 | 3 |
| Relative crystallinity of toner (%) | | 33 | 28 | 46 |
| Low-temperature fixing property | Minimum fixing temperature (° C.) | 105 | 110 | 105 |
| | Evaluation | A | B | A |
| high temperature-resistant offset property | Maximum fixing temperature (° C.) | 170 | 180 | 170 |
| | Evaluation | A | A | A |
| Heat-resistant storage stability | | A | A | A |
| Filming | | A | AA | A |

| | | Comp. Ex. 1 | Comp. Ex. 2 | Comp. Ex. 3 | Comp. Ex. 4 | Comp. Ex. 5 |
|---|---|---|---|---|---|---|
| Crystalline resin A No. | | 1 | 1 | 1 | 3 | 4 |
| Non-crystalline resin B No. | | 1 | 5 | 6 | 1 | 1 |
| Resin E | Resin E No. | — | E6 | E7 | E8 | E9 |
| | Crystalline portion C No. | — | 1 | 1 | 3 | 4 |
| | Non-crystalline portion D No. | — | 5 | 6 | 1 | 1 |
| | Mass ratio (C/D) | — | 0.43 | 0.43 | 0.43 | 0.43 |
| Content of crystalline resin A (% by mass) | | 20 | 10 | 10 | 10 | 10 |
| Content of non-crystalline resin B (% by mass) | | 70 | 50 | 50 | 50 | 50 |
| Content of resin E (% by mass) | | 0 | 30 | 30 | 30 | 30 |
| Content of crystalline portion C (% by mass) | | 0.0 | 9.0 | 9.0 | 9.0 | 9.0 |
| Content of non-crystalline portion D (% by mass) | | 0.0 | 21.0 | 21.0 | 21.0 | 21.0 |
| Mass ratio (A/C) | | — | 1.1 | 1.1 | 1.1 | 1.1 |
| Mass ratio (B/D) | | — | 2.4 | 2.4 | 2.4 | 2.4 |
| Glass transition temperature Tg (° C.) of toner | | 38 | 18 | 52 | 36 | 34 |
| Endothermic peak temperature mp (° C.) of toner | | 58 | 57 | 59 | 82 | 48 |
| Endothermic quantity Q1 of crystalline portion (crystalline resin A and crystalline portion C) in toner (J/g) | | 30 | 20 | 25 | 25 | 20 |
| Endothermic quantity Q2 of crystalline portion (crystalline resin A and crystalline portion C) in toner (J/g) | | 20 | 4 | 7 | 7 | 4 |
| Ratio Q2/Q1 | | 0.67 | 0.20 | 0.28 | 0.28 | 0.20 |
| TMA amount of compressive deformation of toner (%) | | 10 | 9 | 2 | 2 | 8 |
| Relative crystallinity of toner (%) | | 42 | 25 | 27 | 28 | 23 |
| Low-temperature fixing property | Minimum fixing temperature (° C.) | 120 | 105 | 120 | 105 | 120 |
| | Evaluation | F | A | F | A | F |
| High temperature-resistant offset property | Maximum fixing temperature (° C.) | 135 | 155 | 175 | 145 | 170 |
| | Evaluation | F | B | A | F | A |
| Heat-resistant storage stability | | B | F | AA | F | AA |
| Filming | | F | F | AA | B | A |

| | | Comp. Ex. 6 | Comp. Ex. 7 | Comp. Ex. 8 | Comp. Ex. 9 |
|---|---|---|---|---|---|
| Crystalline resin A No. | | 6 | — | 1 | — |
| Non-crystalline resin B No. | | 7 | 1 | — | — |
| Resin E | Resin E No. | E1 | E1 | E1 | E1 |
| | Crystalline portion C No. | 1 | 1 | 1 | 1 |
| | Non-crystalline portion D No. | 1 | 1 | 1 | 1 |
| | Mass ratio (C/D) | 0.43 | 0.43 | 0.43 | 0.43 |
| Content of crystalline resin A (% by mass) | | 10 | 0 | 30 | 0 |
| Content of non-crystalline resin B (% by mass) | | 50 | 70 | 0 | 0 |
| Content of resin E (% by mass) | | 30 | 20 | 60 | 90 |
| Content of crystalline portion C (% by mass) | | 9.0 | 6.0 | 18.0 | 27.0 |
| Content of non-crystalline portion D (% by mass) | | 21.0 | 14.0 | 55.0 | 63.0 |
| Mass ratio (A/C) | | 1.1 | 0.0 | 0.5 | 0.0 |
| Mass ratio (B/D) | | 2.4 | 5.0 | 0.0 | 0.0 |

TABLE 4-continued

| | | | | | |
|---|---|---|---|---|---|
| Glass transition temperature Tg (° C.) of toner | | 35 | 38 | 54 | 38 |
| Endothermic peak temperature mp (° C.) of toner | | 60 | 58 | 60 | 59 |
| Endothermic quantity Q1 of crystalline portion (crystalline resin A and crystalline portion C) in toner (J/g) | | 8 | 3 | 50 | 30 |
| Endothermic quantity Q2 of crystalline portion (crystalline resin A and crystalline portion C) in toner (J/g) | | 1 | 0 | 30 | 6 |
| Ratio Q2/Q1 | | 0.13 | 0.00 | 0.60 | 0.20 |
| TMA amount of compressive deformation of toner (%) | | 7 | 8 | 3 | 8 |
| Relative crystallinity of toner (%) | | 12 | 8 | 55 | 28 |
| Low-temperature fixing property | Minimum fixing temperature (° C.) | 105 | 120 | 120 | 125 |
| | Evaluation | A | F | F | F |
| High temperature-resistant offset property | Maximum fixing temperature (° C.) | 160 | 170 | 130 | 150 |
| | Evaluation | B | A | F | F |
| Heat-resistant storage stability | | F | F | A | F |
| Filming | | B | B | F | A |

From the results of Table 4, the toners of Examples 1 to 17 were superior in terms of all the evaluation items, i.e. low-temperature fixing property, high temperature-resistant offset property, heat-resistant storage stability and filming, compared to the toners of Comparative Examples 1 to 9.

Aspects of the present invention are as follows.

<1> A toner, including;

a binder resin; and a colorant, wherein the toner has a glass transition temperature by differential scanning calorimetry (DSC) of 20° C. or greater and less than 50° C., an endothermic peak temperature by DSC of 50° C. or greater and less than 80° C. and an amount of compressive deformation at 50° C. by thermomechanical analysis of 5% or less.

<2> The toner according to <1>, wherein the binder resin includes a resin having a crystalline portion.

<3> The toner according to <2>, wherein an endothermic quantity Q1 of a first DSC heating due to melting of the crystalline portion and a ratio Q2/Q1 with Q2 being an endothermic quantity Q2 of a second DSC heating satisfy the following formulae (1) and (2):

$$0 \leq Q2/Q1 < 0.3 \quad (1)$$

$$Q1 > 10 J/g \quad (2).$$

<4> The toner according to any one of <2> to <3>, wherein a relative crystallinity obtained from an area of the crystalline portion and an area of a non-crystalline portion by x-ray diffraction method is 10% to 50%.

<5> The toner according to any one of <1> to <4>, wherein the glass transition temperature of the toner is 30° C. to 40° C.

<6> The toner according to any one of <1> to <5>, wherein the binder resin includes: a crystalline resin A, a non-crystalline resin B and a resin E including a crystalline portion C and a non-crystalline portion D in a molecule thereof, and wherein the crystalline resin A, the non-crystalline resin B, the crystalline portion C and the non-crystalline portion D have a mass A (g), a mass B (g), a mass C (g) and a mass D (g), respectively.

<7> The toner according to <6>, wherein the crystalline resin A and the crystalline portion C of the resin E include a common skeleton composed of a monomer unit of an identical type;

wherein the non-crystalline resin B and the non-crystalline portion D of the resin E include a common skeleton composed of a monomer unit of an identical type; or wherein the crystalline resin A and the crystalline portion C of the resin E include a common skeleton composed of a monomer unit of an identical type, and the non-crystalline resin B and the non-crystalline portion D of the resin E include a common skeleton composed of a monomer unit of an identical type.

<8> The toner according to any one of <6> to <7>, wherein both the non-crystalline resin B and the non-crystalline portion D of the resin E include a polyhydroxycarboxylic acid skeleton.

<9> The toner according to any one of <6> to <8>, wherein a content of the crystalline resin A is 3% by mass to 30% by mass <10> The toner according to any one of <6> to <9>, wherein a content of the resin E is 1% by mass to 30% by mass <11> The toner according to any one of <6> to <10>, wherein both the crystalline resin A and the crystalline portion C of the resin E are aliphatic polyester.

<12> The toner according to any one of <6> to <11>, wherein a mass ratio (A/C) of the mass A to the mass C is 0.5 to 3.0.

<13> The toner according to any one of <6> to <12>, wherein a mass ratio (B/D) of the mass B to the mass D is 0.5 to 10.0.

<14> The toner according to any one of <6> to <13>, wherein a mass ratio (C/D) of the mass C to the mass D is 0.25 to 2.5.

<15> A developer, including the toner according to any one of <1> to <14>.

<16> An image forming apparatus, including:

an electrostatic latent image bearing member;

an electrostatic latent image forming unit which forms an electrostatic latent image on the electrostatic latent image bearing member;

a developing unit which forms a visible image by developing the electrostatic latent image with a toner;

a transfer unit which transfers the visible image on a recording medium; and a fixing unit which fixes a transfer image transferred on the recording medium, wherein the toner according to any one of <1> to <14> is mounted as the toner.

<17> An image forming method, including:

an electrostatic latent image forming step where an electrostatic latent image is formed on an electrostatic latent image bearing member;

a developing step where a visible image is formed by developing the electrostatic latent image with a toner;

a transfer step where the visible image is transferred on a recording medium; and a fixing step where a transfer image transferred on the recording medium is fixed, wherein the toner is the toner according to any one of <1> to <14>.

This application claims priority to Japanese application No. 2012-136935, filed on Jun. 18, 2012 and incorporated herein by reference.

What is claimed is:

1. A toner, comprising:

a binder resin comprising a polyester resin A and a polyester resin B which are different from one another; and a colorant, wherein polyester resin A is obtained by condensation polymerization of a linear saturated aliphatic dicarboxylic acid having 4 to 12 carbon atoms and a linear saturated aliphatic diol having 2 to 12 carbon atoms and polyester resin B comprises a bisphenol skeleton, and wherein the toner has a glass transition temperature by differential scanning calorimetry (DSC) of 20° C. or greater and less than 50° C., an endothermic peak temperature by DSC of 50° C. or greater and less than 80° C. and an amount of compressive deformation at 50° C. by thermomechanical analysis of 5% or less.

2. The toner according to claim 1, wherein an endothermic quantity Q1 of a first DSC heating due to melting of the crystalline portion and a ratio Q2/Q1 with Q2 being an endothermic quantity of a second DSC heating satisfy the following formulae (1) and (2):

$$0 \leq Q2/Q1 < 0.3 \quad (1)$$

$$Q1 > 10 J/g \quad (2).$$

3. The toner according to claim 1, wherein a relative crystallinity obtained from an area of the crystalline portion and an area of a non-crystalline portion by x-ray diffraction method is 10% to 50%.

4. The toner according to claim 1, wherein the glass transition temperature of the toner is 30° C. to 40° C.

5. The toner according to claim 1, wherein a content of resin A is 3% by mass to 30% by mass.

6. A developer, comprising:

the toner of claim 1.

7. The toner according to claim 1, further comprising a resin E comprising a crystalline portion C and a non-crystalline portion D in a molecule thereof.

8. The toner according to claim 1, wherein resin A is crystalline and resin B is non-crystalline.

9. The toner according to claim 7, wherein a content of the resin E is 1% by mass to 30% by mass.

10. The toner according to claim 7, wherein resin A is crystalline and resin B is non-crystalline.

11. The toner according to claim 10, wherein the crystalline resin A and the crystalline portion C of the resin E comprise a common skeleton composed of a monomer unit of an identical type; or wherein the non-crystalline resin B and the non-crystalline portion D of the resin E comprise a common skeleton composed of a monomer unit of an identical type; or wherein the crystalline resin A and the crystalline portion C of the resin E comprise a common skeleton composed of a monomer unit of an identical type, and the non-crystalline resin B and the non-crystalline portion D of the resin E comprise a common skeleton composed of a monomer unit of an identical type.

12. The toner according to claim 10, wherein both the non-crystalline resin B and the non-crystalline portion D of the resin E comprise a polyhydroxycarboxylic acid skeleton.

13. The toner according to claim 10, wherein both the crystalline resin A and the crystalline portion C of the resin E are aliphatic polyester.

14. The toner according to claim 10, wherein a mass ratio (A/C) of a mass (g) of the crystalline resin A to a mass (g) of the crystalline portion C of the resin E is 0.5 to 3.0.

15. The toner according to claim 10, wherein a mass ratio (B/D) of a mass (g) of the non-crystalline resin B to a mass (g) of the non-crystalline portion D of the resin E is 0.5 to 10.0.

16. The toner according to claim 10, wherein a mass ratio (C/D) of a mass (g) of the crystalline portion C to a mass (g) of the non-crystalline portion D in the resin E is 0.25 to 2.5.

17. The toner according to claim 10, wherein the crystalline resin A and the crystalline portion C of the resin E comprise a common skeleton composed of a monomer unit of an identical type, and the non-crystalline resin B and the non-crystalline portion D of the resin E comprise a common skeleton composed of a monomer unit of an identical type.

18. An image forming apparatus, comprising:

an electrostatic latent image bearing member;

an electrostatic latent image forming unit which forms an electrostatic latent image on the electrostatic latent image bearing member;

a developing unit which forms a visible image by developing the electrostatic latent image with a toner;

a transfer unit which transfers the visible image on a recording medium; and a fixing unit which fixes a transfer image transferred on the recording medium, wherein the toner is the toner of claim 1.

* * * * *